US009537223B2

(12) United States Patent
Hall et al.

(10) Patent No.: US 9,537,223 B2
(45) Date of Patent: Jan. 3, 2017

(54) MULTI-OUTPUT ANTENNA

(75) Inventors: Peter Hall, Birmingham (GB); Zhenhua Hu, Solihull (GB)

(73) Assignee: Smart Antenna Technologies Ltd., Birmingham (GB)

( * ) Notice: Subject to any disclaimer, the term of this patent is extended or adjusted under 35 U.S.C. 154(b) by 270 days.

(21) Appl. No.: 14/234,951

(22) PCT Filed: Jul. 26, 2012

(86) PCT No.: PCT/GB2012/051799

§ 371 (c)(1),
(2), (4) Date: Jan. 24, 2014

(87) PCT Pub. No.: WO2013/014458

PCT Pub. Date: Jan. 31, 2013

(65) Prior Publication Data

US 2014/0159971 A1 Jun. 12, 2014

(30) Foreign Application Priority Data

Jul. 26, 2011 (GB) ..... 1112839.4

(51) Int. Cl.
*H01Q 21/00* (2006.01)
*H01Q 1/24* (2006.01)
(Continued)

(52) U.S. Cl.
CPC ..... *H01Q 21/0006* (2013.01); *H01Q 1/243* (2013.01); *H01Q 5/335* (2015.01); *H01Q 21/28* (2013.01)

(58) Field of Classification Search
CPC ..... H01Q 9/145; H01Q 9/30; H01Q 9/14; H01Q 23/00; H01Q 1/243
(Continued)

(56) References Cited

U.S. PATENT DOCUMENTS 5,386,203 A 1/1995 Ishihara
8,203,492 B2 * 6/2012 Anguera ..... H01Q 1/243 343/702
(Continued)

FOREIGN PATENT DOCUMENTS

CN 102110900 A 6/2011
DE 3844541 A1 10/1989
(Continued)

OTHER PUBLICATIONS

Search Report from counterpart GB Application No. GB1112839.4, dated Nov. 7, 2011, 4 pp.
(Continued)

*Primary Examiner* — Huedung Mancuso
(74) *Attorney, Agent, or Firm* — Shumaker & Sieffert, P.A.

(57) ABSTRACT

A reconfigurable multi-output antenna (16) is disclosed comprising: one or more radiating elements (12, 14), at least two matching circuits (42, 44, 50, 52) coupled to the or each radiating element (12, 14) via e.g. a splitter (30, 32) or a duplexer; and wherein each matching circuit (42, 44, 50, 52) is associated with a separate port (38, 40, 46, 48) arranged to drive a separate resonant frequency so that the or each radiating element (12, 14) is operable to provide multiple outputs simultaneously. The resonant frequency of each output is independently controllable by each matching circuit, with good isolation with each other port, thereby offering very wide operating frequency range with simultaneous multi-independent output operations. Also described is a multi-output antenna control module for coupling to one or more radiating elements, an antenna structure and an antenna interface module. A reconfigurable multi-output antenna is disclosed comprising: one or more radiating.

20 Claims, 16 Drawing Sheets

(51) Int. Cl.
*H01Q 21/28* (2006.01)
*H01Q 5/335* (2015.01)

(58) Field of Classification Search
USPC ..... 343/745, 859
See application file for complete search history.

(56) References Cited

U.S. PATENT DOCUMENTS

| | | | | |
|---|---|---|---|---|
| 8,237,615 | B2 * | 8/2012 | Anguera | H01Q 1/243 343/702 |
| 8,958,845 | B2 * | 2/2015 | Alexopoulos | H01Q 1/521 455/550.1 |
| 9,147,929 | B2 * | 9/2015 | Anguera | H01Q 1/243 |
| 2004/0127178 | A1 | 7/2004 | Kuffner | |
| 2005/0035915 | A1 * | 2/2005 | Livingston | H01Q 1/422 343/754 |
| 2005/0181847 | A1 | 8/2005 | Boyle | |
| 2005/0233764 | A1 | 10/2005 | Solski et al. | |
| 2007/0146212 | A1 | 6/2007 | Ozden et al. | |
| 2007/0241985 | A1 | 10/2007 | Suzuki et al. | |
| 2008/0273579 | A1 | 11/2008 | Rofougaran et al. | |
| 2009/0289871 | A1 | 11/2009 | Lin et al. | |
| 2011/0206165 | A1 | 8/2011 | Satou et al. | |
| 2012/0229366 | A1 * | 9/2012 | Ding | H01Q 9/0414 343/907 |

FOREIGN PATENT DOCUMENTS

| | | | |
|---|---|---|---|
| EP | 1798807 | A1 | 6/2007 |
| EP | 2660933 | A1 | 11/2013 |
| GB | 2239355 | A | 6/1991 |
| JP | 201155258 | A | 3/2011 |
| JP | 2011055258 | A | 3/2011 |
| WO | 0199230 | A1 | 12/2001 |
| WO | 2010050149 | A1 | 5/2010 |
| WO | 2011048357 | A1 | 4/2011 |
| WO | 2011064444 | A1 | 6/2011 |

OTHER PUBLICATIONS

Examination Report from counterpart European Application No. 12750798.6, dated Jul. 20, 2015, 10 pp.

International Search Report and Written Opinion for corresponding PCT Application No. PCT/GB2012/051799, dated Oct. 10, 2012 (18 pgs.).

Villanen, et al., "Compact Antenna Structures for Mobile Handsets," IEEE, Oct. 6, 2013; pp. 40-44.

* cited by examiner

MULTI-OUTPUT ANTENNA

FIELD OF THE INVENTION

The invention relates to a multi-output antenna. Particularly, but not exclusively, the invention relates to a multi-output antenna for use in a portable electronic device such as a mobile telephone, laptop, personal digital assistant (PDA) or radio.

BACKGROUND TO THE INVENTION

With growing requirements for connectivity in a highly mobile environment, more standards and services are being rolled out (such as DVB-H, RFID, RDF, UWB, LTE etc). For this reason some believe that future mobile terminals will need to incorporate more than 20 separate antennas. It will therefore be challenging for mobile terminal designers to fit all of these antennas into the small amount of space which is available in a handset.

There are many proposals for reconfigurable antenna designs which would help to alleviate this problem. In particular, the applicants have devised a reconfigurable antenna described in WO2011/048357 which has an extremely wide tuning range. However, this antenna is only able to access two services simultaneously. For example, the antenna can only support DVB-H (470 MHz) and GSM (900 MHz) signals or DVB-H (470 MHz) and WiFi (2400 MHz) or GSM (900 MHz) and GPS (1500 MHz) but it cannot support more than two of these services simultaneously, as required by current mobile devices which can require simultaneous access to GSM, GPS and WiFi. Furthermore, this particular antenna is unlikely to be adequate for future Cognitive Radio systems which will require multi-resolution spectrum sensing.

If multi-services or multi-spectrum sensing is required in the future then one solution would be to use more reconfigurable antennas. However, as mentioned above, providing multiple antennas in a small device is impracticable and so the system designers still need to address the problem concerning the small amount of space available to provide such services.

An aim of the present invention is therefore to provide a multi-output antenna which helps to address the above-mentioned problems.

SUMMARY OF THE INVENTION

According to a first aspect of the present invention there is provided a multi-output antenna comprising: one or more radiating elements, at least two matching circuits coupled to the or each radiating element; and wherein each matching circuit is associated with a separate port arranged to drive a separate resonant frequency so that the or each radiating element is operable to provide multiple outputs simultaneously.

According to a second aspect of the present invention there is provided a multi-output antenna control module for coupling to one or more radiating elements, the control module comprising: at least two matching circuits arranged for coupling to the or each radiating element; and wherein each matching circuit is associated with a separate port arranged to drive a separate resonant frequency so that the or each radiating element is operable to provide multiple outputs simultaneously.

Embodiments of the present invention therefore provide an antenna and/or a control module having multiple matching circuits which can be operated simultaneously to provide multiple outputs. Accordingly, a single antenna of the present invention can mimic the output from multiple separate antennas, whilst occupying less space than that required for said multiple separate antennas. More specifically, the aspects of the present invention allow use of fewer radiating elements, thus also reducing the problems associated with the coupling of separate radiating elements when they are placed in close proximity. Furthermore, as the matching circuits may be permanently coupled to the radiating elements so that the ports can be operated simultaneously, embodiments of the present invention can negate the need for switches and other complex circuitry required in order to select or isolate a particular output.

Advantageously, the resonant frequency of each output may be independently controllable by each matching circuit, with good isolation with each other port, thereby offering very wide operating frequency range with simultaneous multi-independent output operations. Thus, the multiple outputs/ports may have independent frequency control (i.e. when the resonant frequency of port one is changed, the resonant frequency of port two will be unaffected and will remain the same).

As a consequence of the above, antennas according to the present invention are ideal candidates for use in small terminals which require access to multiple services simultaneously or which require multiple searching functionality such as for Cognitive Radio systems.

In certain embodiments, the multi-output antenna may be tunable (i.e. adjustable or reconfigurable) so that each output may operate at a plurality of different operating frequencies.

The multi-output antenna may further comprise a radiating chassis and the one or more radiating elements may be configured to excite multiple resonance modes of the radiating chassis to provide said multiple outputs. The chassis may be constituted by a substrate or printed circuit board (PCB). The size, shape and location of each radiating element may be chosen to optimise the multiple chassis resonance modes.

The or each radiating element may be coupled to the at least two matching circuits via a splitter circuit. The splitter circuit may therefore serve to divide a single feed port for the radiating element into two (or more) ports. It will be understood that each port may incorporate an independent matching circuit configured to drive its own operating frequency and bandwidth without significantly affecting any other resonance frequencies associated with other ports.

The splitter circuit may comprise an LC circuit comprising a capacitor and an inductor connected in parallel and joined at a T-junction into the single feed port. The capacitor of the splitter circuit may be connected in series with a first matching circuit associated with a first port. The inductor of the splitter circuit may be connected in series with a second matching circuit associated with a second port.

Each matching circuit may be reconfigurable to enable their respective ports to tune their outputs to different frequencies. The matching circuits may comprise one or more than one inductor or capacitor (e.g. in the form of an L-C circuit) and may comprise a variable capacitor (i.e. varactor).

In a particular embodiment, each matching circuit may comprise a first inductor connected in parallel with a capacitor, which in turn is connected in series with a second inductor. The first inductor may be connected to a ground plane and the capacitor may be variable and may be constituted by a varactor. The varactor may have any suitable tuning range such as 2 pF to 10 pF, 0.1 pF to 12 pF or 0.3 pF to 0.8 pF.

In embodiments of the invention, the values of the components in the splitter circuit and/or each matching circuit may be chosen so that the first and second ports are uncorrelated whilst still achieving reasonable efficiency for each port.

In embodiments of the present invention, each matching circuit may be structurally identical (i.e. having the same components arranged in the same manner, although not necessarily having the same values). It will be understood that such an arrangement can provide very good resonance although different matching circuits may also be employed in certain circumstances.

In certain embodiments of the invention, at least one alternative component may be provided for inclusion in the matching circuits. At least one switch may be provided to enable the at least one alternative component to be activated in place of another component. In certain embodiments, the first inductor may be selectable from a group of at least two possible inductors and/or the second inductor may be selectable from a group of at least two other possible inductors.

It will be understood that the provision of alternative components for the matching circuits allows greater flexibility in the configuration of the antenna and therefore allows the tuning range of the antenna to be greatly increased.

In a particular embodiment, a pair of radiating elements may be provided, each of which is coupled to two (or more) matching circuits which are in turn associated with two (or more) different ports so that the antenna is operable to provide up to four (or more) outputs simultaneously. Thus, 2 pairs of radiating elements can provide 8 outputs, 4 pairs of radiating elements can provide 16 outputs and so on. If more than two matching circuits and ports are associated with each radiating element, the number of outputs can be increased since the number of outputs is determined by the number of radiating elements multiplied by the number of matching circuits/ports per radiating element.

Each pair of radiating elements may be coupled together, as described, for example, in WO2011/048357. Thus, each pair of radiating elements may comprise mutually coupled radiating elements, each having an associated feed port which is split into two separate ports in accordance with the present invention and wherein each port is provided with a separate impedance-matching circuit configured for independent tuning of one of two distinct outputs associated with each radiating element. Each radiating element may also be arranged for selective operation in each of the following states: a driven state, a floating state and a ground state.

At least one of the radiating elements of the may be constituted by a non-resonant resonator. In a particular embodiment, two non-resonant resonators are employed. Each radiating element may be configured to operate over a wideband and/or a narrowband range of frequencies. In a particular embodiment, each impedance-matching circuit may comprise a wideband tuning circuit and a narrowband tuning circuit.

In one embodiment, the antenna is provided on a substrate (e.g. chassis) having a ground plane printed on a first side thereof. A first radiating element may be provided on the second side of the substrate, opposite to the first side, and laterally spaced from the ground plane. The first radiating element may be constituted by a metal patch, which may be planar or otherwise. In a specific embodiment, the first radiating element may be constituted by an L-shaped metal patch, having a planar portion and a portion orthogonal to the ground plane. The orthogonal portion may extend from an edge of the planar portion furthest from the ground plane such that the orthogonal portion is spaced from the ground plane by a so-called first gap.

A second radiating element may be constituted by a metal patch, which may be planar or otherwise. In a particular embodiment, the second radiating element is constituted by a planar metal patch, orthogonal to the ground plane. The second radiating element may be located between the ground plane and the orthogonal portion of the first radiating element (i.e. within the first gap). The distance between the ground plane and the second radiating element will form a so-called second gap. It will be understood that, in this embodiment, the distance between the second radiating element and the orthogonal portion of the first radiating element will determine the amount of mutual coupling therebetween. This distance will therefore be referred to throughout as the mutual gap.

The shape of each radiating element is not particularly limited and may be, for example, square, rectangular, triangular, circular, elliptical, annular, trapezium-shaped, star-shaped or irregular. Furthermore, each radiating element may include at least one notch or cut-out. It will be understood that the shape and configuration of each radiating element will depend upon the desired characteristics of the antenna for the applications in question.

Similarly, the size and shape of the ground plane may be varied to provide the optimum characteristics for all modes of operation. Accordingly, the first ground plane may be, for example, square, rectangular, triangular, circular, elliptical, annular trapezium-shaped, star-shaped or irregular. Furthermore, the ground plane may include at least one notch or cut-out.

Each port may be connected to a control system comprising a control means for selecting the operating state of the associated output. The control system may comprise a switch selectively configured to allow the output to float, to be connected to the ground plane or to be driven by its associated impedance-matching circuit.

In the above embodiment, a first feed port may be provided between the first radiating element and a first splitter circuit and a second feed port may be provided between the second radiating element and a second splitter circuit.

The first feed port may be positioned in the centre of the radiating element or off-centre (i.e. closer to one side of the radiating element than the other).

In a specific embodiment, the first feed port may be located approximately one third of the distance along the length of the first radiating element. This is advantageous in that it causes non-symmetrical current to be generated along the ground plane thereby supporting many different resonances. It also enables the first radiating element to generate more resonances due to it having a different electrical length in each direction. In addition, positioning the first feed port off-centre allows more space for the second radiating element to be positioned close to the first radiating element which, in turn, results in a better coupling between the two radiating elements.

The first feed port may be connected to the ground plane along an edge thereof. The first feed port may be connected at the centre of the edge or at or towards one side thereof. Having the first feed port connected at a side of the ground plane allows the second radiating element to make full use of the width of the ground plane. However, it also results in a different coupling efficiency between the radiating elements and the ground plane.

In certain embodiments, the second feed port is placed in close proximity to the first feed port. This enables each feed port to be operated independently (ON), or as a driver to the adjacent feed port (Ground), or to be electrically disconnected (OFF). Thus, it is possible to dynamically tune the operating frequency of each radiating element by selecting different modes of operation in relation to each radiating element. The table below provides some possible operating states based on selecting a combination of the above states for the first feed port (Feed Port 1) and the second feed port (Feed Port 2).

TABLE 1

Possible operating states of the antenna

| State | Mode 1 | Feed Port 1 | Mode 2 | Feed Port 2 |
|---|---|---|---|---|
| 1 | Feed antenna | ON | Parasitic | Ground |
| 2 | Parasitic | Ground | Feed antenna | ON |
| 3 | Feed antenna | ON | Floating | OFF |
| 4 | Floating | OFF | Feed antenna | ON |
| 5 | Feed antenna | ON | Feed antenna | ON |

It will be understood that Mode 1 and Mode 2 represent the operating modes of the first radiating element and the second radiating element, respectively. Accordingly, when a feed port is ON the associated radiating element serves as a driven (or feed) antenna resonating at the frequencies supported by the corresponding impedance-matching circuits. When the feed port is OFF (i.e. electrically disconnected) the associated radiating element is permitted to float (i.e. to resonate at any supported frequency). When the feed port is at Ground the associated radiating element serves as a parasitic element (i.e. resonating at a particular frequency, effectively preventing the other radiating element from supporting that frequency). It will therefore be appreciated that embodiments of the present invention enable a diverse set of operating modes allowing increased tunability over conventional antenna designs.

In an embodiment of the present invention, the first radiating element may have a tuning range of approximately 0.4 to 3 GHz and the second radiating element may have a tuning range of approximately 1.6 to 3 GHz (or higher).

As each radiating element is coupled to two ports, each having separate impedance matching circuits, a tuning capacitor may be employed in each matching circuit to tune the two separate outputs of each radiating element.

In certain embodiments three or more radiating elements may be employed to further increase the frequency tuning agility of the antenna. A third or subsequent radiating element may be located within the first gap defined above. The third or subsequent radiating elements may be configured to operate at frequencies greater than 3 GHz.

It will be understood that a merit of employing an antenna as described above is that it enables those knowledgeable in the art to easily configure the antenna to a multitude of simultaneous operating frequencies. Furthermore, various impedance-matching circuit configurations can be easily implemented to enable the antenna to operate in both a listening and an application mode. Thus, the antenna design described above can provide a wide frequency tuning range or wideband performance.

The substrate may be of any convenient size and in one embodiment may have a surface area of approximately $116\times40$ mm$^2$ so that it can easily be accommodated in a conventional mobile device. It will be understood that the thickness of the substrate is not limited but will typically be a few millimeters thick (e.g. 1 mm, 1.5 mm, 2 mm or 2.5 mm).

In an embodiment of the invention, the first and second radiating elements may extend over an area of approximately $40\times10$ mm$^2$. It will be understood that the size of each radiating element is not limited and can be increased when a wider operation bandwidth or higher gain is required.

It has been demonstrated that, in an embodiment of the present invention, an antenna has been designed which has an independent wide tuning rage for each output and can operate over a frequency range from 456 MHz up to 2946 MHz with at least a 6 dB return loss across the operating band and good isolation between each port.

The multi-output antenna of the present invention may be configured as a chassis antenna for use in a portable device.

The antenna may be configured for Multiple-Input-Multiple-Output (MIMO) applications. Thus, the antenna may be incorporated into a system having multiple antennas. Each antenna may be in accordance with the present invention and may be configured to provide multiple uncorrelated channels to increase the capacity of the system without the need for additional spectrum or transmitter power.

According to a third aspect of the present invention there is provided an antenna structure for MIMO applications comprising at least one antenna according to the first aspect of the invention and at least one further antenna.

The at least one further antenna may be constituted by a balanced or unbalanced antenna and may be reconfigurable. In one embodiment, the at least one further antenna may also be in accordance with the first aspect of the invention.

The relative positions of each antenna may be chosen so as to provide good (or optimal) antenna isolation. In some embodiments, this may be obtained by spacing each antenna from the other by the largest available distance. In practice, a first antenna may be located at a first end of the structure and a second antenna may be located at a second end of the structure.

In embodiments of the invention, the first and second antennas may be spaced by at least 200 mm, at least 150 mm, at least 100 mm or at least 50 mm.

It will be understood that a parametric study may be undertaken to evaluate the optimum construction of a particular antenna structure according to an embodiment of the present invention.

According to a fourth aspect of the present invention there is provided an antenna interface module comprising: a multi-output antenna according to the first aspect of the invention; and an automatic tuning system configured to tune each of the multiple outputs to a target operating frequency.

The automatic tuning system may therefore optimise the antenna performance in light of environmental changes and may reduce the effect of a user's hand or body on the operating frequencies. More specifically, the same (universal) antenna interface module may be provided in a number of different devices and the automatic tuning system may be employed to compensate for differences in the size and/or shape of each device and, in particular, differences in the size and/or shape of each substrate (e.g. chassis) on which the interface module is mounted.

The automatic tuning system may comprise at least one varactor coupled to each matching circuit and/or splitter circuit. The automatic tuning system may be arranged to monitor a power level of a reflected signal of the target operating frequency (e.g. at the associated port) and to adjust a bias voltage of the at least one varactor so as to minimise the power level of the reflected signal. The automatic tuning system may therefore further comprise a directional coupler, a power detector, an analogue to digital converter (ADC), a microprocessor and at least one digital to analogue converter (DAC). The number of digital to analogue converters may correspond to the number of varactors provided in each matching circuit and/or splitter circuit so that the bias voltage of each varactor is provided by a separate digital to analogue converter.

The automatic tuning system may comprise further varactors (and associated digital to analogue converters) in order to improve the matching performance of the antenna, offer more flexibility and improve the signal sensitivity in different environments.

The multi-output antenna control module may further comprise the automatic tuning system described above.

BRIEF DESCRIPTION OF THE DRAWINGS

Certain embodiments of the present invention will now be described with reference to the accompanying drawings in which.

DETAILED DESCRIPTION OF CERTAIN EMBODIMENTS

Figure 1:
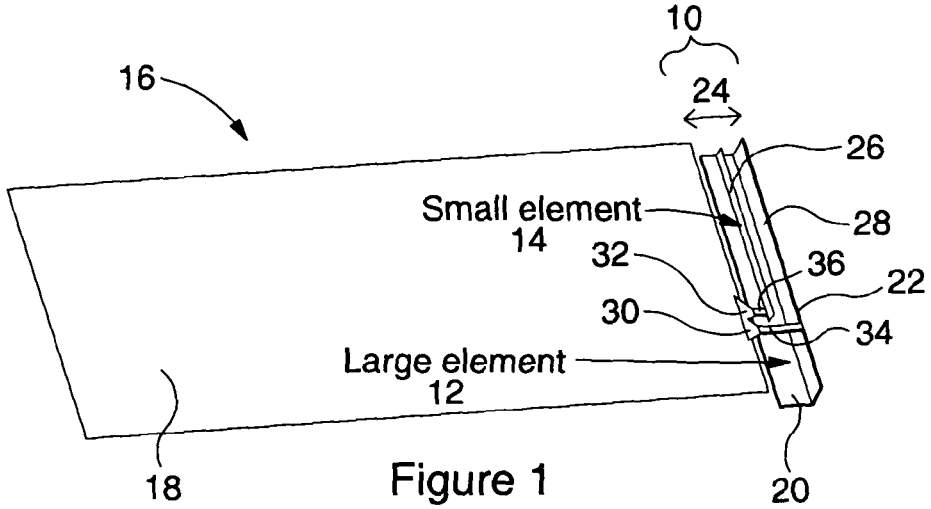
FIG. 1 shows a top perspective view of a pair of coupled radiating elements for an antenna according to an embodiment of the present invention.

With reference to FIG. 1 there is shown a pair 10 of coupled radiating elements 12, 14 for an antenna 16 according to an embodiment of the present invention. The radiating elements 12, 14 are similar to those described in WO2011/048357, are mounted in close proximity to each other and are driven over a PCB ground plane 18. Although, in practice, the radiating elements 12, 14 and ground plane 18 are provided on a substrate, no substrate is shown in FIG. 1 for purposes of clarity.

It should be noted that the antenna 16 is fairly simple in construction and in having the ground plane 18 measuring 100×40 $mm^2$ and the pair 10 of radiating elements 12, 14 occupying a very small volumetric space of 40×5×7 $mm^3$, the antenna 16 meets the requirements for use in the mobile phone industry.

In this particular embodiment, the first radiating element 12 is constituted by an L-shaped microstrip patch having a planar portion 20, parallel to the ground plane 18, and an orthogonal portion 22, orthogonal to the ground plane 18. It will be understood that the planar portion 20 is provided on the opposite side of the substrate from the ground plane 18, laterally spaced therefrom. The orthogonal portion 22 extends from an edge of the planar portion 20 furthest from the ground plane 18 such that the orthogonal portion 22 is spaced from the ground plane 18 by a so-called first gap 24. In this particular embodiment the first gap 24 is less that 10 mm.

The second radiating element 14 is also constituted by a microstrip patch which, in this case, forms a planar rectangle. The second radiating element 14 is also orientated orthogonally to the ground plane 18 and is located within the first gap 24. Thus, the second radiating element 14 is effectively enclosed on two adjacent sides by the L-shaped first radiating element 12. In the embodiment shown, the second radiating element 14 is just over half of the length of the first radiating element 12 and extends from a side edge of the first radiating element 12. The distance between the ground plane 18 and the second radiating element 14 forms a so-called second gap 26. The distance between the second radiating element 14 and the orthogonal portion 22 of the first radiating element 12 will determine the amount of mutual coupling therebetween and this distance is therefore referred to as the mutual gap 28.

Figure 2:
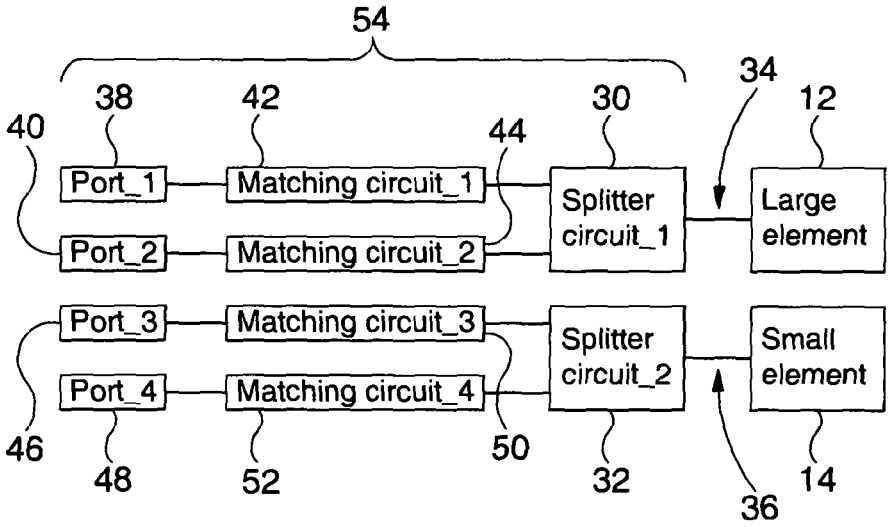
FIG. 2 shows a block diagram of the circuitry associated with the radiating elements of FIG. 1.

As shown in FIG. 2, each radiating element 12, 14 is connected, respectively, to a first and second splitter circuit 30, 32 via a first and second feed port 34, 36. In this particular embodiment, the first and second feed ports 34, 36 are constituted by wires, however, in other embodiments other feed mechanisms could be employed such as microstrip feed lines or non-direct electromagnetic coupling.

Referring back to FIG. 1, the first feed port 34 extends between the orthogonal portion 22 of the first radiating element 12 and the first splitter circuit 30, which is situated close to the nearest edge of the ground plane 18, and is located approximately one third of the distance along the length of the first radiating element 12. As described above, this is advantageous in that it allows the ground plane 18 and the first radiating element 12 to support many different resonances. The second feed port 36 is located adjacent to the first feed port 34 and connects to the adjacent second splitter circuit 32.

As illustrated in FIG. 2, the first splitter circuit 30 is arranged to divide the one and only first feed port 34 of the first radiating element 12 into a first port 38 and a second port 40. The first port 38 is provided with a first matching circuit 42 and the second port 40 is provided with a second matching circuit 44. Similarly, the second splitter 32 is arranged to divide the one and only second feed port 36 of the second radiating element 14 into a third port 46 and a fourth port 48. The third port 46 is provided with a third matching circuit 50 and the fourth port 48 is provided with a fourth matching circuit 52. Together, the two splitter circuits 30, 32, the four matching circuits 42, 44, 50, 52 and the four ports 38, 40, 46, 48 make up a control module 54 for the multi-output antenna 16. The control module 54 may also comprise control means for driving each of the ports and tuning each of the matching circuits in accordance with system requirements.

Figure 3:
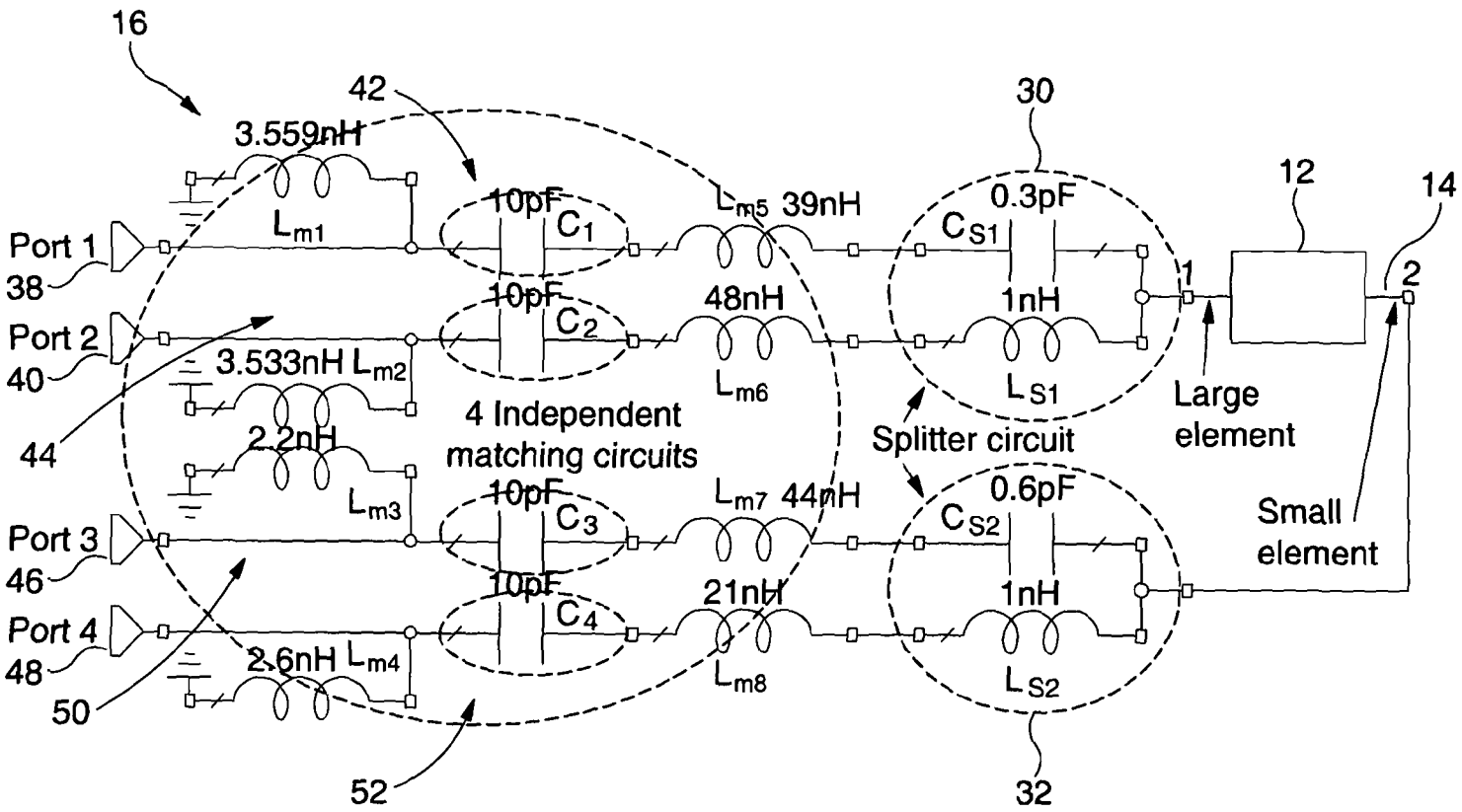
FIG. 3 shows a circuit diagram corresponding to the antenna structure of FIG. 2.

FIG. 3 shows a circuit diagram corresponding to the antenna 16 illustrated in FIG. 2. Each splitter circuit 30, 32 comprises a capacitor $C_{S1}$, $C_{S2}$ and an inductor $L_{S1}$, $L_{S2}$ connected in parallel and joined at a T-junction into the respective first and second feed ports 34, 36. The capacitor $C_{S1}$ of the first splitter circuit 30 has a value of 0.3 pF, capacitor $C_{S2}$ of the second splitter circuit 32 has a value of 0.6 pF, and the each inductor $L_{S1}$, $L_{S2}$ has a value of 1 nH.

The capacitor $C_{S1}$ of the first splitter circuit 30 is connected in series with the first matching circuit 42 while the inductor $L_{S1}$ of the first splitter circuit 30 is connected in series with the second matching circuit 44. Similarly, the capacitor $C_{S2}$ of the second splitter circuit 32 is connected in series with the third matching circuit 50 while the inductor $L_{S2}$ of the second splitter circuit 32 is connected in series with the fourth matching circuit 52.

Each matching circuit 42, 44, 50, 52 comprises a first inductor $L_{M1}$, $L_{M2}$, $L_{M3}$, $L_{M4}$ connected in parallel with a varactor $C_1$, $C_2$, $C_3$, $C_4$, which in turn is connected in series with a second inductor $L_{M5}$, $L_{M6}$, $L_{M7}$, $L_{M8}$. The first inductors $L_{M1}$, $L_{M2}$, $L_{M3}$, $L_{M4}$ are all connected to a ground plane and the values of each the inductor are as follows: $L_{M1}$=3.559 nH, $L_{M2}$=3.533 nH, $L_{M3}$=2.2 nH, $L_{M4}$=2.6 nH, $L_{M5}$=39 nH, $L_{M6}$=48 nH, $L_{M7}$=4.4 nH, $L_{M8}$=21 nH. The varactors $C_1$, $C_2$, $C_3$, $C_4$ all have a tuning range of 0.2 pF up 10 pF so as to enable the respective ports 38, 40, 46, 48 to tune their associated output resonances to different frequencies.

It is noted that the first step in the design process of the antenna 16 was to simulate the structure illustrated in FIG. 1. All of the simulations were performed using the transient solver in CST Microwave Studio®. The s2p file representing the antenna response was then used as a starting point for designing the matching networks shown in FIG. 3. The values of the components within each of the independent matching circuits were then adjusted in order to optimize the return loss performance of the antenna 16 and the isolation between each port 38, 40, 46, 48. The varactors $C_1$, $C_2$, $C_3$, $C_4$ were all fixed to 10 pF during this phase of the design process. Furthermore, the values of the components in the splitter circuits 30, 32 were chosen to provide 4 uncorrelated outputs whilst still achieving reasonable efficiency for each port 38, 40, 46, 48.

Figure 4:
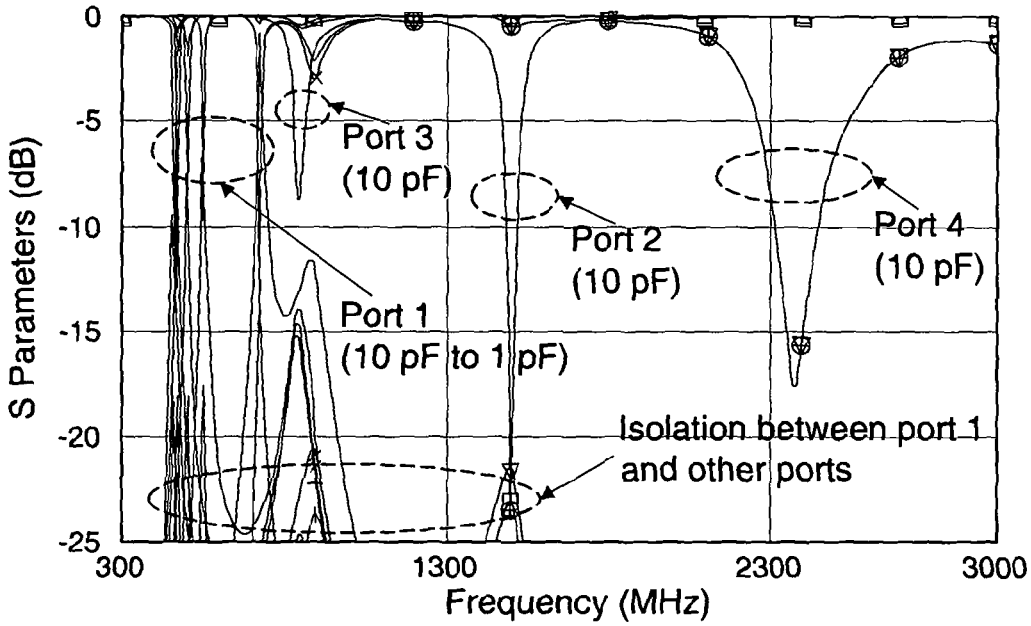
FIG. 4 shows a graph of return loss against frequency for a first configuration of the circuit shown in FIG. 3, when $C_1$ is varied from 1 pF to 10 pF while $C_2$, $C_3$ and $C_4$ are fixed at 10 pF.

FIG. 4 shows a graph of simulated return loss against frequency for a first configuration of the circuit shown in FIG. 3, when $C_1$ is varied from 10 pF to 1 pF while $C_2$, $C_3$ and $C_4$ are fixed at 10 pF. Thus, it can be seen that is possible to move the resonant frequency associated with the first port 38 (Port 1) from 459 MHz to 723 MHz by changing the value of the varactor $C_1$. The resonant frequencies associated with the second port 40 (Port 2), third port 46 (Port 3) and fourth port 48 (Port 4) are also illustrated in FIG. 4 and it is apparent that only the resonance frequency of Port 3 was slightly affected as the varactor $C_1$ was varied as the resonance frequencies of other two ports were close to static.

Figure 5:
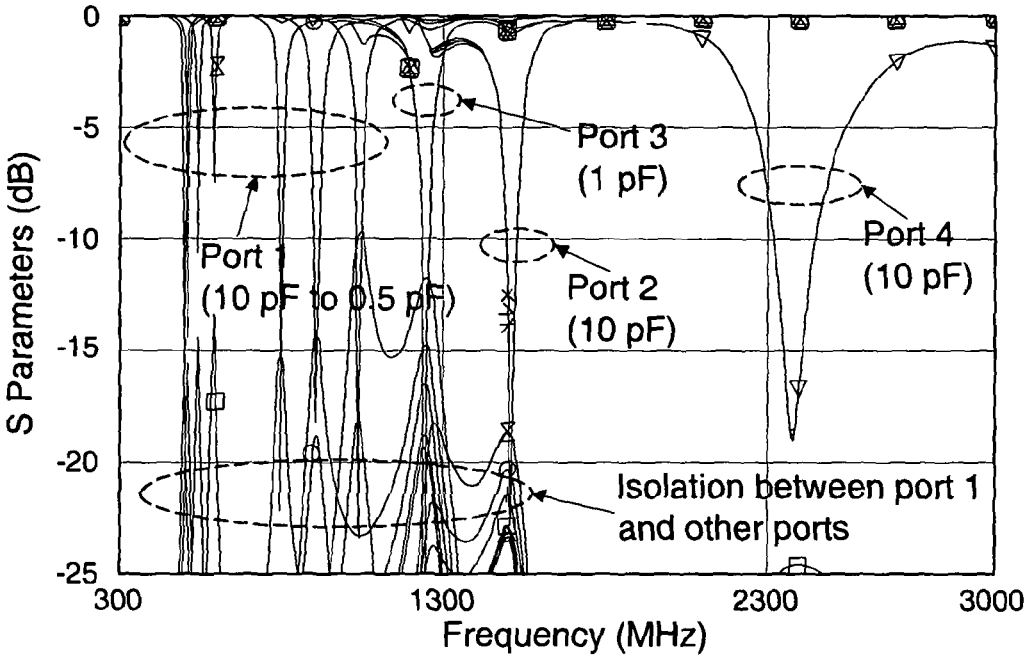
FIG. 5 shows a graph of return loss against frequency for a second configuration of the circuit shown in FIG. 3, when $C_1$ is varied from 0.5 pF to 10 pF while $C_3$ is fixed at 1 pF, and $C_2$ and $C_4$ are fixed at 10 pF.

However, it was also noted that the isolation between Port 1 and Port 3 deteriorated (i.e. the coupling increased) as the two resonances became closer together. Consequently, a further simulation was obtained and is shown in FIG. 5 for the case when the varactor $C_1$ is varied from 10 pF to 0.5 pF while $C_3$ is fixed at 1 pF and the other two varactors (i.e. $C_2$ and $C_4$) were fixed at 10 pF. In this case, the resonance frequency of Port 1 was tuned from 459 MHz to 1038 MHz with good isolation (i.e. below −7 dB) from all other ports, including Port 3.

Figure 6:
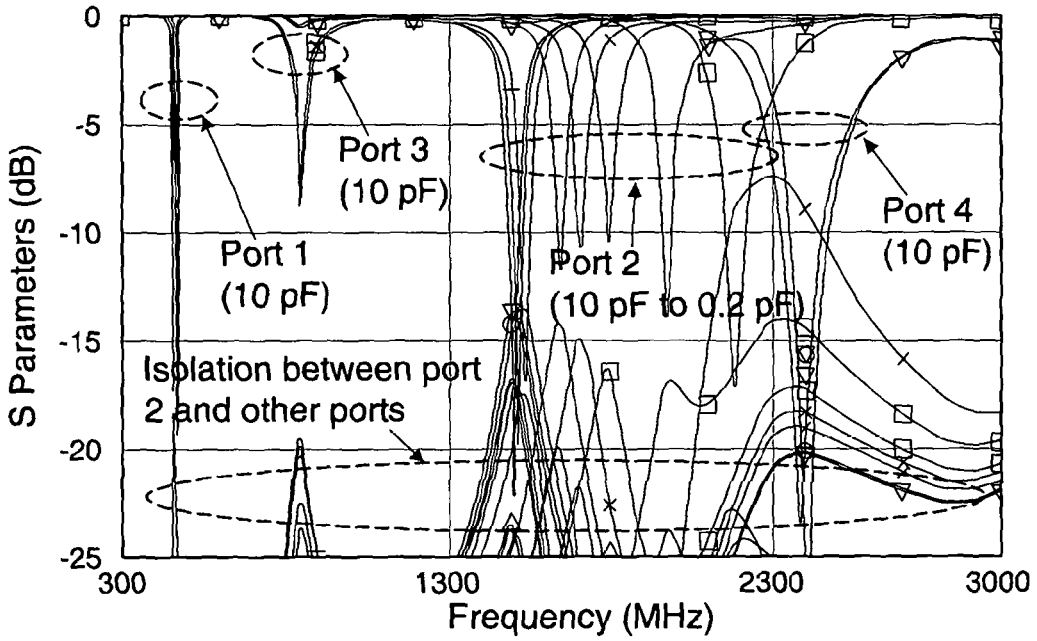
FIG. 6 shows a graph of return loss against frequency for a third configuration of the circuit shown in FIG. 3, when $C_2$ is varied from 0.2 pF to 10 pF while $C_1$, $C_3$ and $C_4$ are fixed at 10 pF.

FIG. 6 shows a graph of simulated return loss against frequency for a third configuration of the circuit shown in FIG. 3 in which $C_2$ is varied from 10 pF to 0.2 pF while $C_1$, $C_3$ and $C_4$ are fixed at 10 pF. It is therefore possible to move the resonance frequency of Port 2 from 1500 MHz to 2181 MHz with good isolation (i.e. below −7 dB) with all other ports.

Figure 7:
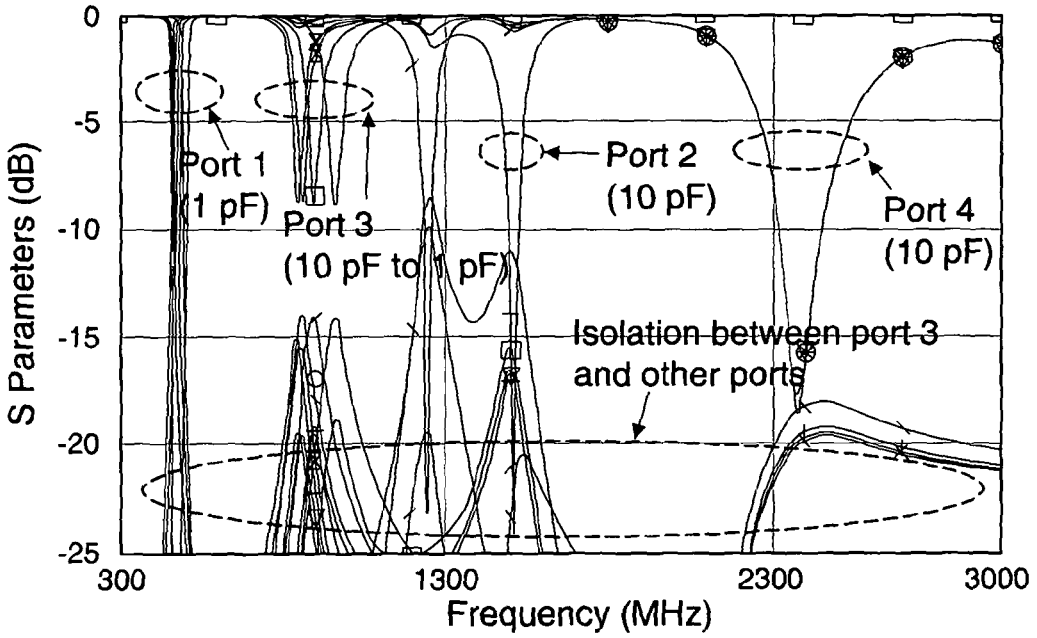
FIG. 7 shows a graph of return loss against frequency for a fourth configuration of the circuit shown in FIG. 3, when $C_3$ is varied from 1 pF to 10 pF while $C_1$, $C_2$ and $C_4$ are fixed at 10 pF.

Similarly, FIG. 7 shows a graph of simulated return loss against frequency for a fourth configuration of the circuit shown in FIG. 3, in which $C_3$ is varied from 10 pF to 1 pF while $C_1$, $C_2$ and $C_4$ are fixed at 10 pF. In this case, the resonance frequency of Port 3 is tuned from 843 MHz to 1242 MHz.

Figure 8:
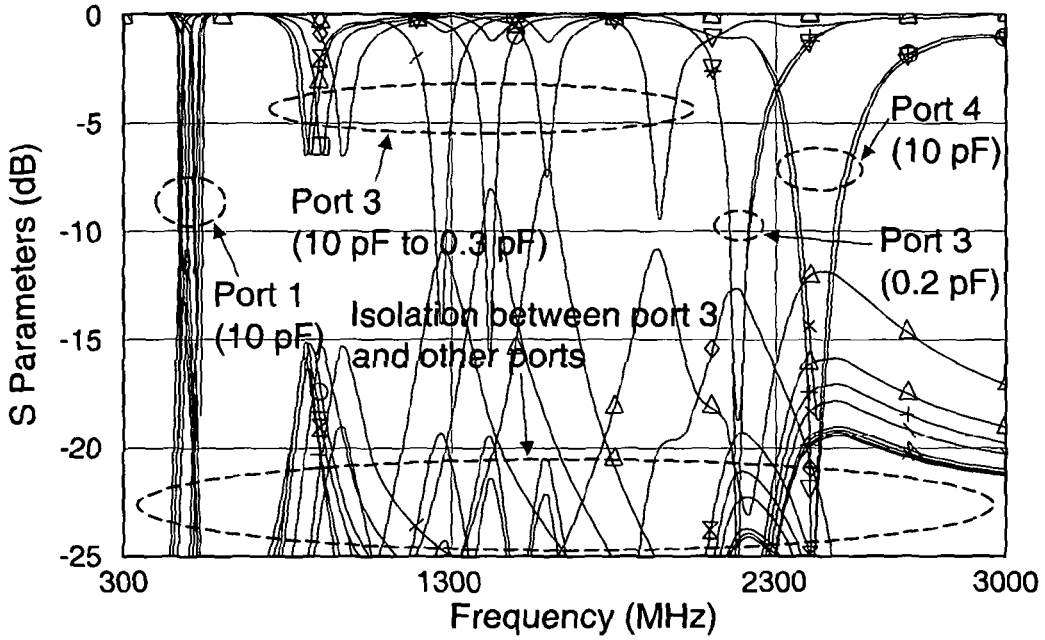
FIG. 8 shows a graph of return loss against frequency for a fifth configuration of the circuit shown in FIG. 3, when $C_3$ is varied from 0.3 pF to 10 pF while $C_2$ is fixed at 1 pF, and $C_1$ and $C_4$ are fixed at 10 pF.

FIG. 8 shows the simulated return loss when the varactor $C_3$ is varied from 10 pF to 0.3 pF while $C_2$ is fixed at 0.2 pF and the other two varactors (i.e. $C_1$ and $C_4$) are fixed at 10 pF. In this instance, the resonance frequency of Port 3 can be tuned from 843 MHz to 1935 MHz with good isolation (i.e. below −7 dB) with all of the other ports.

Figure 9:
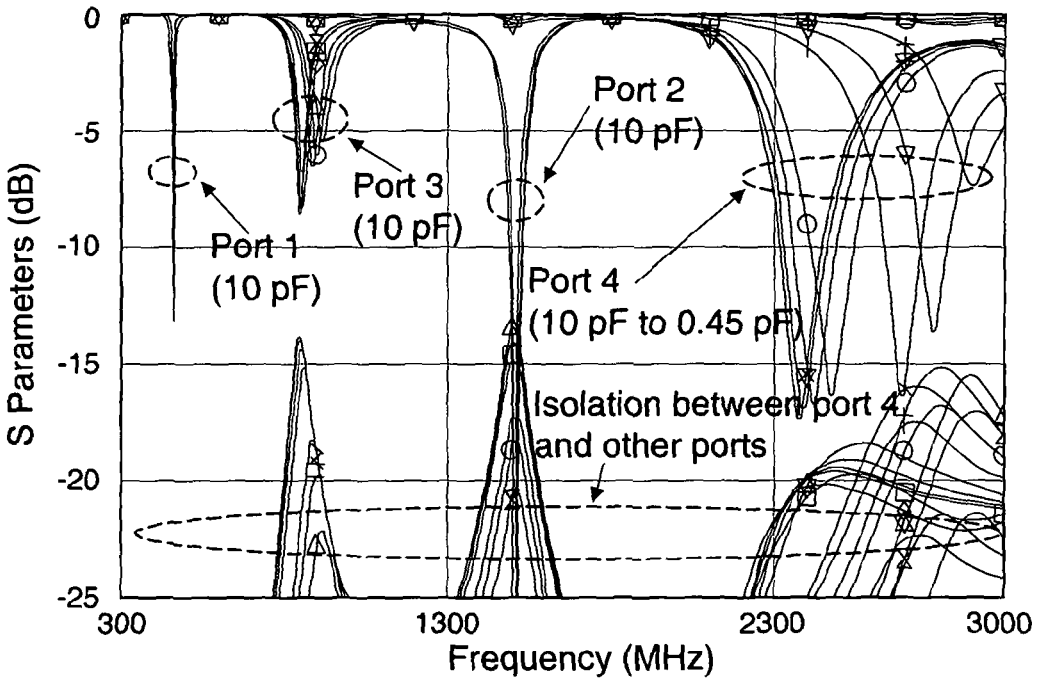
FIG. 9 shows a graph of return loss against frequency for a sixth configuration of the circuit shown in FIG. 3, when $C_4$ is varied from 0.45 pF to 10 pF while $C_1$, $C_2$ and $C_3$ are fixed at 10 pF.

Lastly, FIG. 9 shows a graph of simulated return loss against frequency for a sixth configuration of the circuit shown in FIG. 3, when $C_4$ is varied from 10 pF to 0.45 pF while $C_1$, $C_2$ and $C_3$ are fixed at 10 pF. In this way it is possible to move the resonance frequency of Port 4 from 2373 MHz to 2901 MHz with good isolation (i.e. below −7 dB) with all of the other ports.

According to the above simulated results, it is apparent that by tuning the independent matching circuits associated with each port it is possible to alter the operating frequency and bandwidth associated with that port without affecting the resonant frequencies of the other ports.

Table 1 below summaries the efficiency and realised gain of the antenna system with the ideal components simulated (i.e. without parasitic loss) and the results are generally very good, making the antenna an suitable candidate for use as a multi-output chassis antenna for as portable device.

TABLE 1

Simulated Efficiency and Gain for the multi-output chassis-antenna with ideal circuit components

| Port | Frequency (MHz) | Radiation Efficiency (dB) | Total Efficiency (dB) | Realized Gain (dB) |
|---|---|---|---|---|
| 1 | 459 | −2.274 | −3.665 | −3.221 |
| 2 | 843 | 0 | −0.937 | 1.021 |
| 3 | 1500 | 0 | −0.272 | 3.691 |
| 4 | 2373 | 0 | −0.164 | 4.631 |

In order to validate the above, the applicants also simulated an antenna having real components and fabricated and demonstrated a prototype device. The intention was not only to demonstrate the frequency agility of the antenna system, but also its potential for use in a mobile device covering DVB-H, GSM710, GSM850, GSM900, GPS1575, GSM1800, PCS1900, and UMTS2100 simultaneously or for use in a Cognitive Radio system which requires multi-resolution spectrum sensing.

Figure 10A:
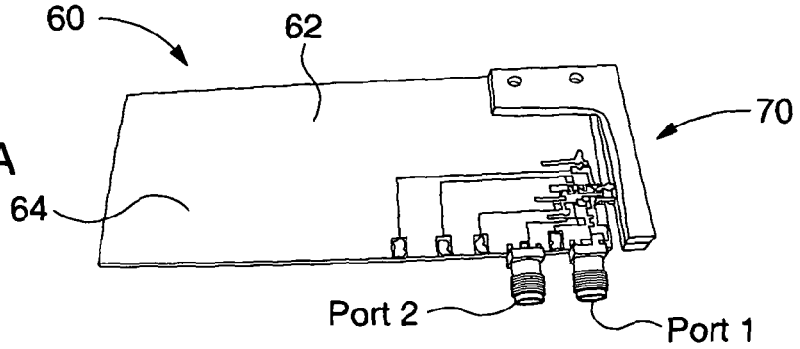
FIG. 10A shows a top view of a fabricated antenna structure according to the block diagram of FIG. 2.
Figure 10B:
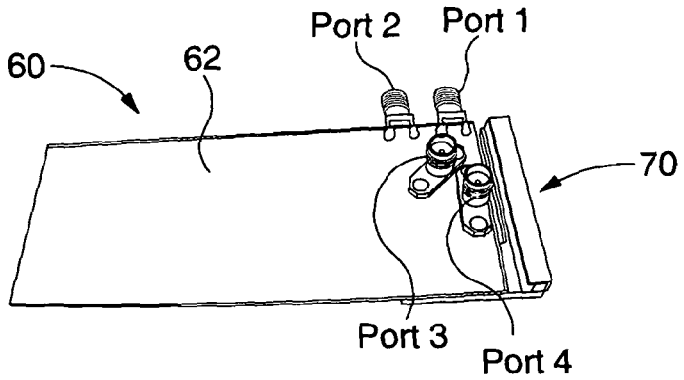
FIG. 10B shows a rear view of a fabricated antenna structure according to the block diagram of FIG. 2.

The prototype chassis-antenna 60 is illustrated in FIGS. 10A and 10B and comprises the pair of coupled radiating elements of FIG. 1 connected to the splitter circuits, matching circuits and ports of FIGS. 2 and 3. In this instance, the antenna 60 was fabricated from a microwave substrate 62 (of material known as TLY-3-0450-C5) having a permittivity of 2.33 and a thickness of 1.143 mm, provided with a metal ground plate 64 having a thickness of 0.01778 mm. The coupled radiating elements were supported by a Rohacell™ foam structure 70, which has a dielectric constant of 1.08 within the operating frequency bands. The electrical components of FIG. 3 were each provided on the substrate 62 and connected to each of the respective ports (Port 1, Port 2, Port 3 and Port 4). Accordingly, the single pair of coupling elements 70 was used to excite four separate resonances in the device.

In the embodiment tested, the varactors $C_1$, $C_2$, $C_3$, $C_4$ of FIG. 3 were replaced with capacitors having a fixed value of 10 pF for demonstration purposes.

Figure 11:
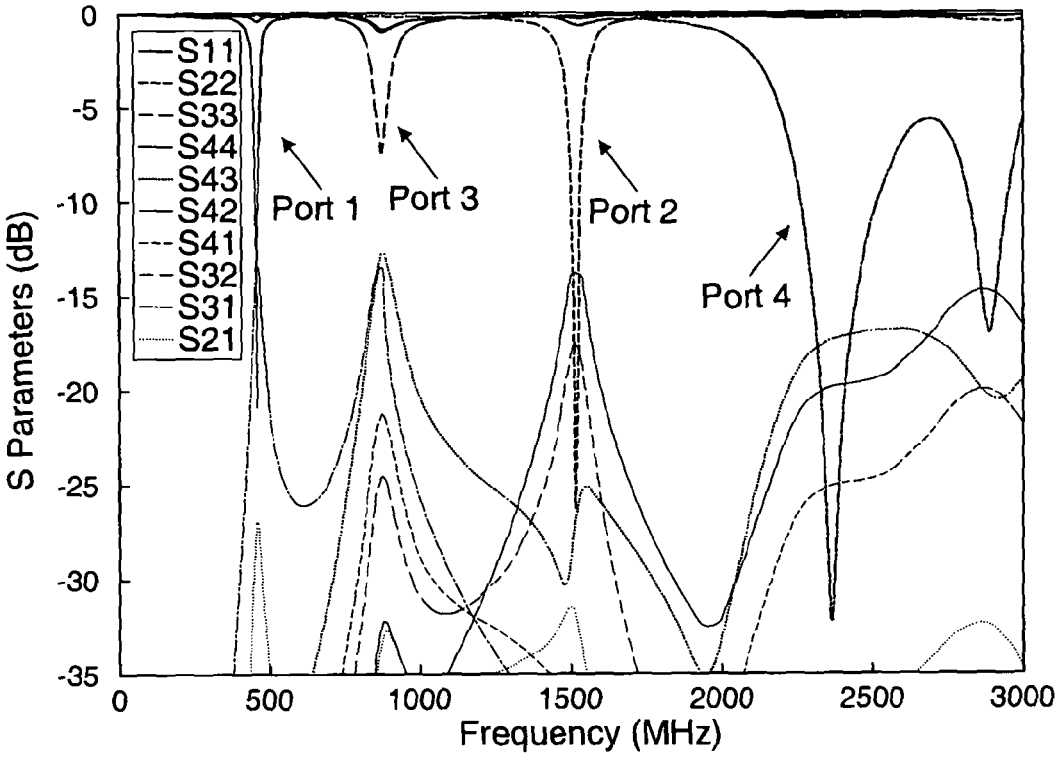
FIG. 11 shows a simulated graph of return loss against frequency for the multi-output chassis-antenna shown in FIGS. 10A and 10B, when $C_1$, $C_2$, $C_3$ and $C_4$ are fixed at 10 pF.

FIG. 11 illustrates the simulated S parameters for the antenna 60, when real components are employed. This shows that the resonance frequencies for the 4 ports are 462 MHz, 876 MHz, 1518 MHz and 2370 MHz, with a return loss of −20.83 dB, −7.462 dB, −26.25 dB and −32.36 dB, respectively. It can also be seen from FIG. 11 that the coupling between each port all occurs below −12 dB.

Table 2 shows the simulated efficiencies and realized gain for the antenna 60 when real components are employed. For example, Port 1 has a realized gain of −9.959 dB at 462 MHz which meets specification requires and the outputs from the other ports also have reasonable efficiency and realized gain.

TABLE 2

Simulated Efficiency and Gain for the prototype antenna shown in FIG. 10 with real circuit components

| Port | Frequency (MHz) | Radiation Efficiency (dB) | Total Efficiency (dB) | Realized Gain (dB) |
|---|---|---|---|---|
| 1 | 462 | −11.35 | −11.59 | −9.959 |
| 2 | 876 | −1.942 | −3.373 | −1.422 |
| 3 | 1518 | −3.252 | −3.577 | 0.676 |
| 4 | 2370 | −0.331 | −0.465 | 4.235 |

Figure 12:
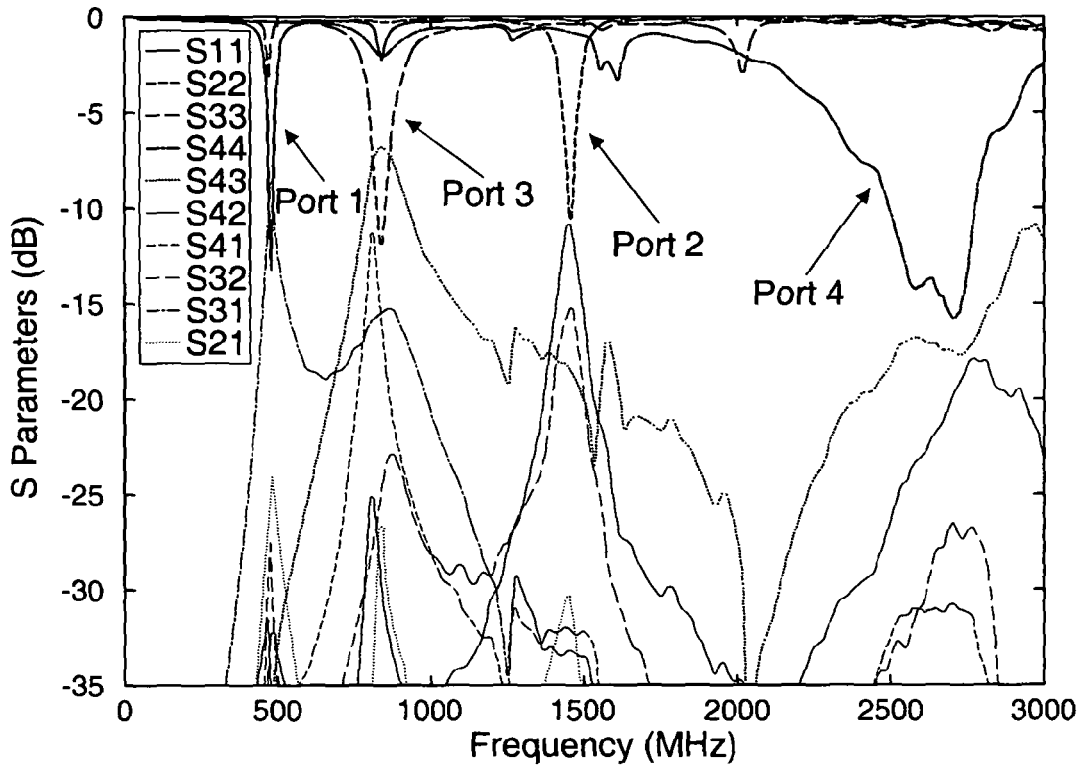
FIG. 12 shows a measured graph of return loss against frequency for the multi-output chassis-antenna shown in FIGS. 10A and 10B, when $C_1$, $C_2$, $C_3$ and $C_4$ are fixed at 10 pF.

FIG. 12 illustrates the measured S parameters for the antenna 60. The measured results show that the resonance frequencies for the 4 ports are 481 MHz, 837 MHz, 1459

MHz and 2711 MHz, with a return loss of −13.25 dB, −11.94 dB, −10.66 dB and −15.83 dB, respectively. FIG. 12 also shows that the coupling between each port is generally below −7 dB except for the coupling between ports 3 and ports 4 (i.e. S43) which is −6.76 dB. In general, the measured results compare well with the simulations and it is believed that any discrepancies are due to manufacturing tolerances (e.g. as a result of additional solder).

It should be clear from the above that by operating with splitter circuits and matching circuits as described, the antenna 60 (with a single pair of coupled radiating elements 70) can provide 4 outputs with independent frequency tunable behaviour and which together can cover a frequency range from 456 MHz to 2946 MHz with a 6 dB return loss across the operating band.

Figure 13:
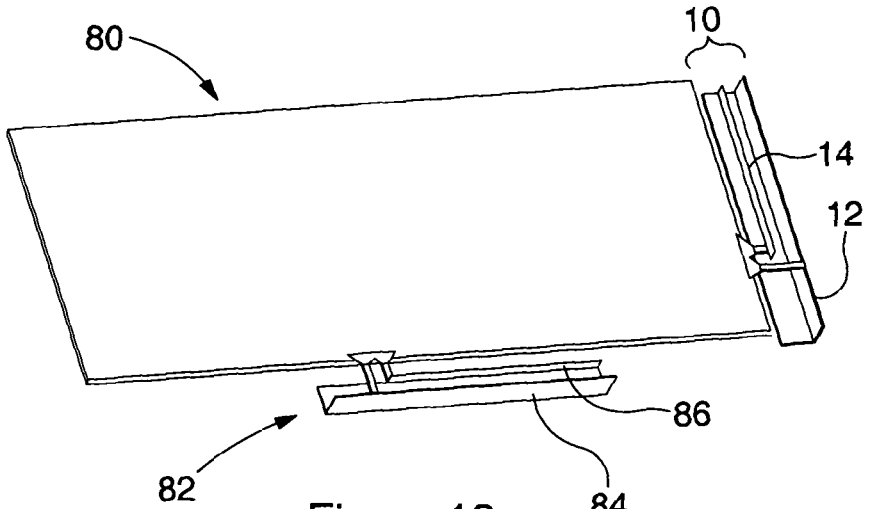
FIG. 13 shows a top perspective view of a the structure of a chassis-antenna according to a further embodiment of the invention, having two pairs of coupled radiating elements.

The applicants also propose the use of splitter circuits and matching circuits with more pairs of coupled radiating elements so as to provide even more independently tunable outputs. In order to validate this concept, a chassis-antenna 80 having 2 pairs of coupled radiating elements was simulated. The structure of the radiating elements of the antenna 80 is shown in FIG. 13. The antenna 80 is essentially identical to that described above in relation to FIG. 1 but also comprises a second pair 82 of coupled radiating elements 84, 86. The second pair 82 of coupled radiating elements 84, 86 is identical to the first pair 10 of coupled radiating elements 12, 14 described above but is located adjacent the middle of a side of the substrate. However, it should be noted that the location of the second pair 82 of coupled radiating elements 84, 86 is not limited and can be provided at any position around the substrate. It will also be clear that further pairs of coupled radiating elements (or even further individual radiating elements) may be incorporated into the antenna 80 to further increase the number of outputs.

Figure 14:
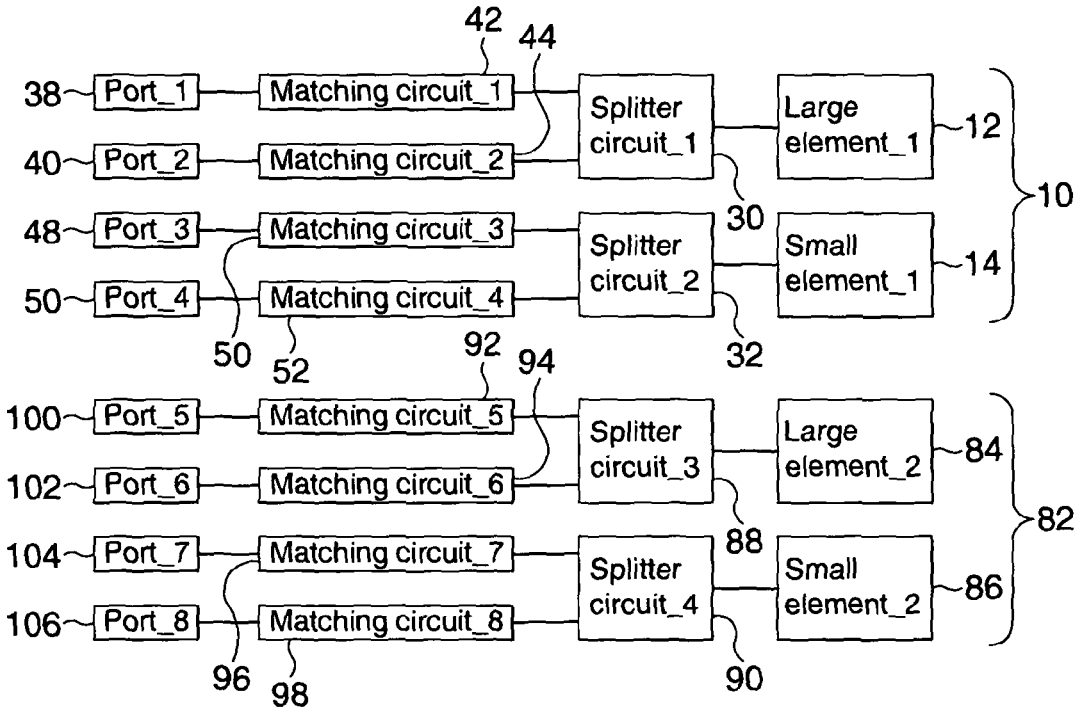
FIG. 14 shows a block diagram of the circuitry associated with the radiating elements of FIG. 13.

As illustrated in FIG. 14, each radiating element 12, 14, 84, 86 is connected via a feed line to a splitter circuit 30, 32, 88, 90 and each splitter circuit 30, 32, 88, 90 is in turn connected to two separate matching circuits 42, 44, 50, 52, 92, 94, 96, 98 associated with two separate ports 38, 40, 48, 50, 100, 102, 104, 106. The structure of each of the matching circuits and splitter circuits is identical to that shown in FIG. 3 although the values of each of the components may be different as determined adjusting the values to optimize the return loss performance of the antenna 80 and the isolation between each port.

Figure 15:
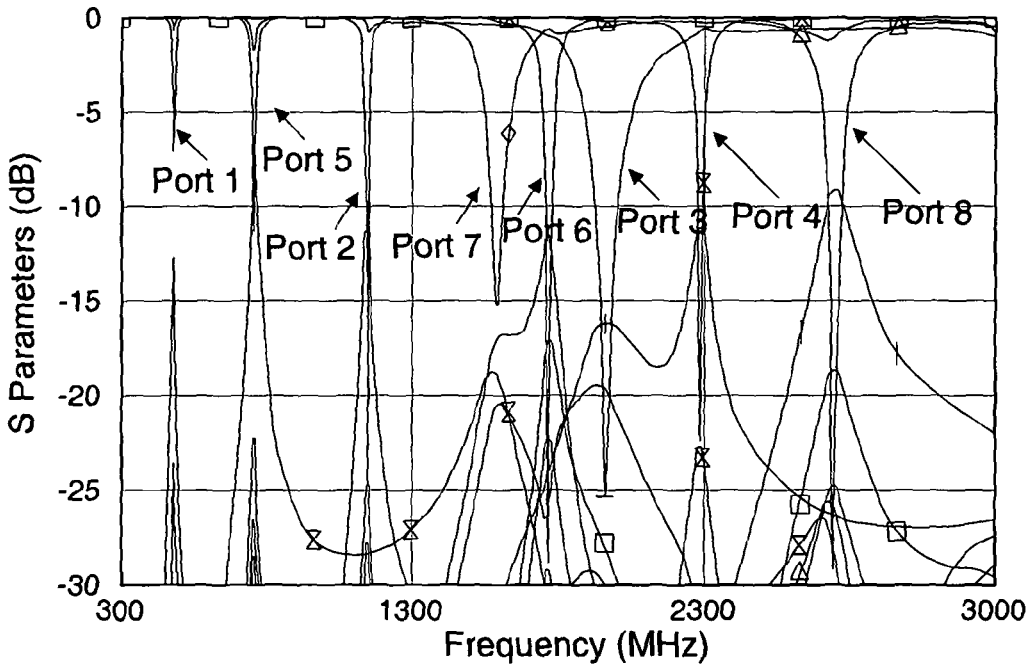
FIG. 15 shows a simulated graph of return loss against frequency for the multi-output chassis-antenna shown in FIGS. 13 and 14, when the varactors in each of the matching circuits are fixed at 10 pF.

As shown in FIG. 15, by employing 2 pairs of coupled radiating elements, it is possible to obtain 8 independently tunable outputs (1, 2, 3, 4, 5, 6, 7, 8). The 8 resonance frequencies obtained in this example are 460 MHz, 710 MHz, 1060 MHz, 1460 MHz, 1620 MHz, 1790 MHz, 2090 MHz and 2500 MHz, with a return loss of −8.374 dB, −8.326 dB, −16.96 dB, −15.24 dB, −28.88 dB, −20.7 dB, −17.25 dB and −30.47 dB, respectively. The maximum isolation between the ports in FIG. 15 is −6.42 dB.

Figure 16:
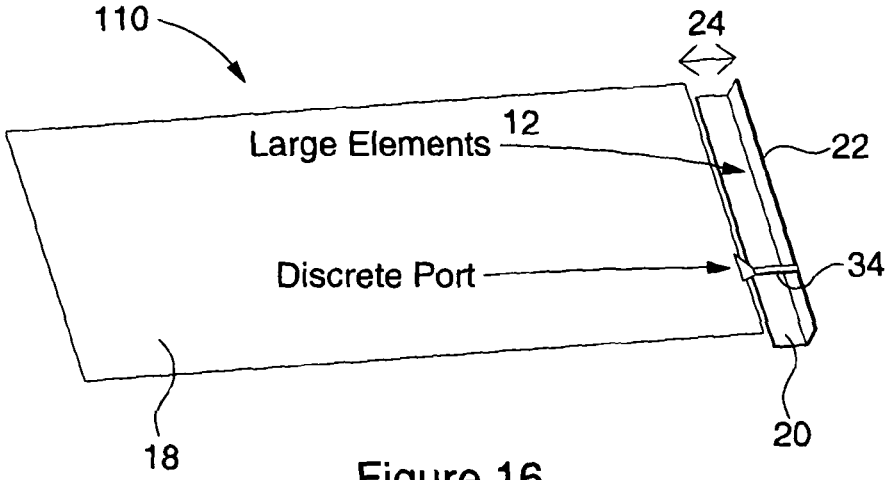
FIG. 16 shows a top perspective view of an embodiment of the present invention which is similar to that shown in FIG. 1 but wherein only a single, large, radiating element is provided.

FIG. 16 shows a top perspective view of a multi-output antenna 110 which is similar to that shown in FIG. 1 but wherein only a single, large, radiating element 12 is used to excite the resonance in a handset chassis. As before, the radiating element 12 is constituted by an L-shaped microstrip patch having a planar portion 20, parallel to a ground plane 18, and an orthogonal portion 22, orthogonal to the ground plane 18. The planar portion 20 is provided on the opposite side of a substrate (not shown) from the ground plane 18, laterally spaced therefrom. The orthogonal portion 22 extends from an edge of the planar portion 20 furthest from the ground plane 18 such that the orthogonal portion 22 is spaced from the ground plane 18 by a first gap 24. In this particular embodiment the first gap 24 is less that 10 mm.

Unlike in FIG. 1, the antenna 110 has a ground plane 18 measuring 50×20 $mm^2$ and the radiating element 12 occupies a space of 20×2×3.5 $mm^3$, the antenna 110 is therefore well-suited to use in the mobile phone industry.

Figure 17:
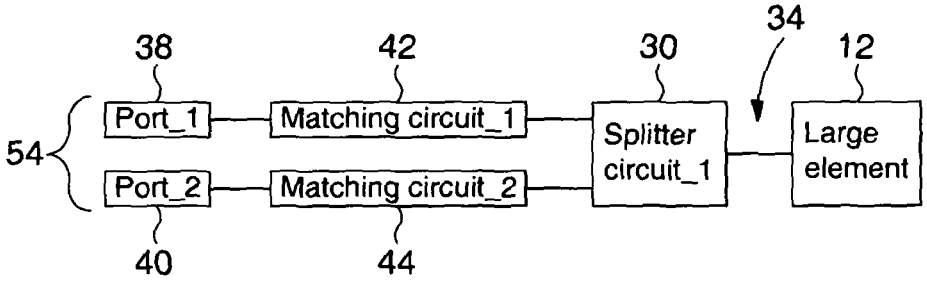
FIG. 17 shows a block diagram of the circuitry associated with the radiating element of FIG. 16.

As shown in FIG. 17, the single radiating element 12 is connected to a first splitter circuit 30 via a first feed port 34. Referring back to FIG. 16, the first feed port 34 extends between the orthogonal portion 22 of the radiating element 12 and the first splitter circuit 30 (illustrated in FIG. 17), which is situated close to the nearest edge of the ground plane 18, and is located approximately one third of the distance along the length of the radiating element 12.

As illustrated in FIG. 17, the first splitter circuit 30 is arranged to divide the one and only first feed port 34 of the radiating element 12 into a first port 38 and a second port 40. The first port 38 is provided with a first matching circuit 42 and the second port 40 is provided with a second matching circuit 44. Together, the splitter circuit 30, the two matching circuits 42, 44, and the two ports 38, 40 make up a control module 54 for the multi-output antenna 110. As before, the control module 54 may also comprise control means for driving each of the ports and tuning each of the matching circuits in accordance with system requirements. It will be understood that as each port incorporates an independent matching circuit its operating frequency and bandwidth can be altered independently, without affecting other resonance frequencies, such as that controlled via the other port.

Although not shown separately, the circuit structure corresponding to the arrangement of FIG. 17 is as illustrated in FIG. 3 in relation to the large radiating element 12 and comprises a first varactor $C_1$ and a second varactor $C_2$.

Figure 18:
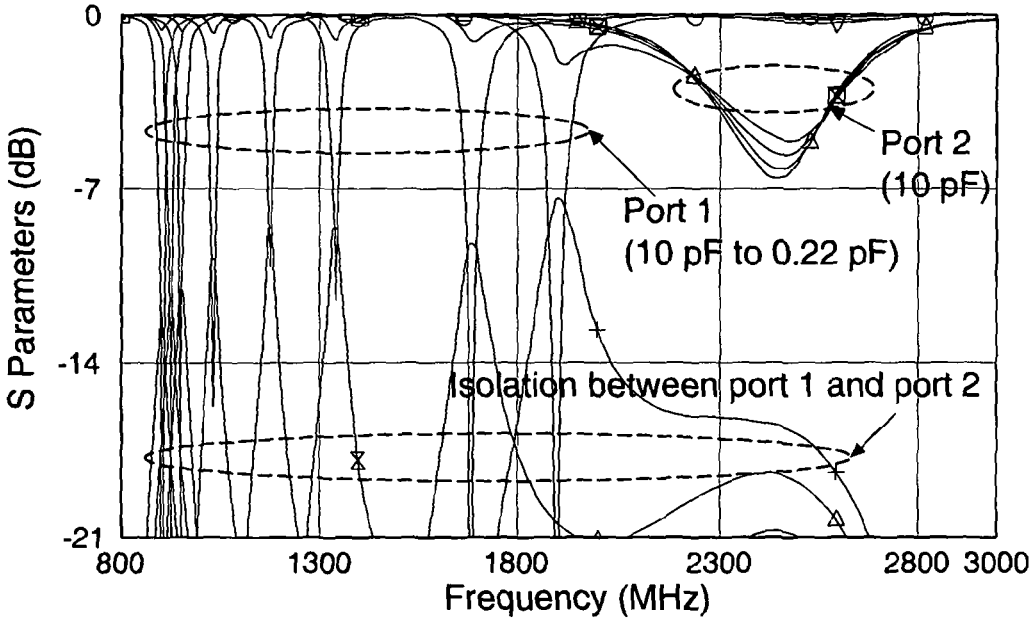
FIG. 18 shows a simulated graph of return loss against frequency for the multi-output chassis-antenna shown in FIGS. 16 and 17, when a first varactor $C_1$ is varied from 0.22 pF to 10 pF while a second varactor $C_2$ is fixed at 10 pF.
Figure 19:
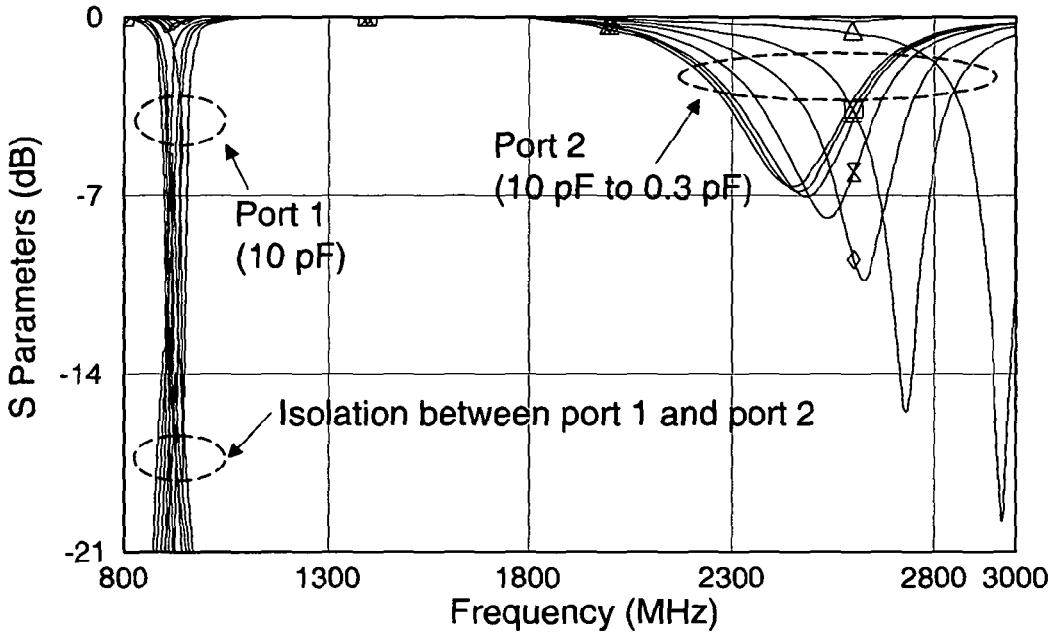
FIG. 19 shows a simulated graph of return loss against frequency for the multi-output chassis-antenna shown in FIGS. 16 and 17, when the second varactor $C_2$ is varied from 0.3 pF to 10 pF while the first varactor $C_1$ is fixed at 10 pF.

FIG. 18 shows a simulated graph of return loss against frequency for the multi-output chassis-antenna 110 shown in FIGS. 16 and 17, when the first varactor $C_1$ is varied from 0.22 pF to 10 pF while the second varactor $C_2$ is fixed at 10 pF. As illustrated, this set-up allows the resonance frequency of Port 1 to be moved from 900 MHz to 1896 MHz, with good isolation (i.e. below −7 dB) with the Port 2. FIG. 19 shows a simulated graph of return loss against frequency for the multi-output chassis-antenna 110 shown in FIGS. 16 and 17, when the second varactor $C_2$ is varied from 0.3 pF to 10 pF while the first varactor $C_1$ is fixed at 10 pF. As illustrated, this allows the resonance frequency of Port 2 to be moved from 2448 MHz to over 3000 MHz, with good isolation (i.e. below −7 dB) with Port 1. Thus, with a single radiating element 12 it is possible to have two independent outputs.

Figure 20:
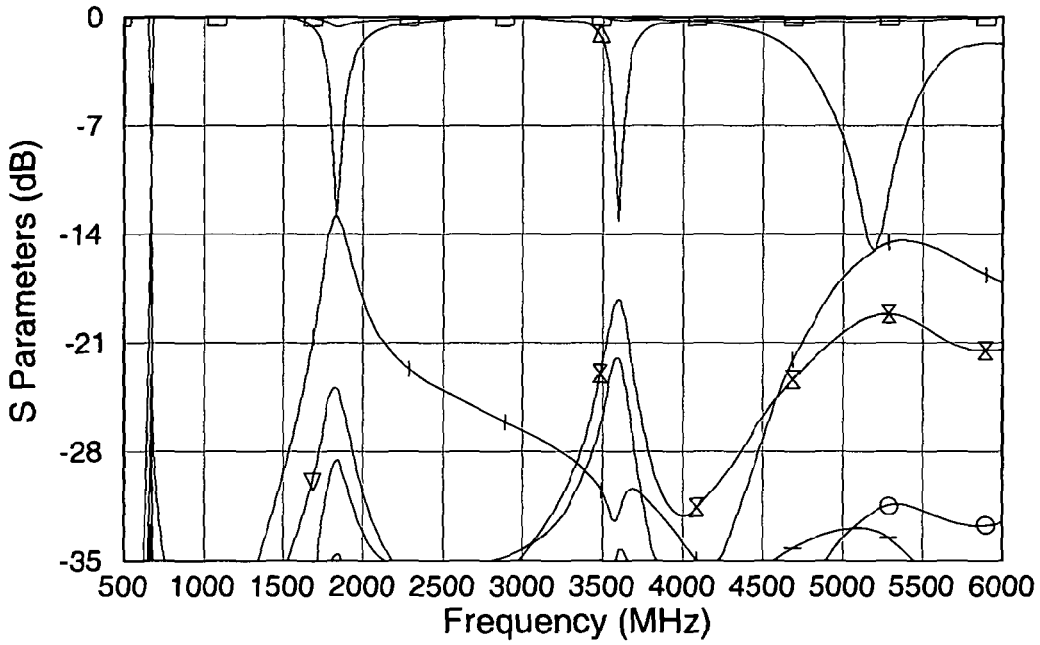
FIG. 20 shows a simulated graph of return loss against frequency for the multi-output chassis-antenna shown in FIGS. 1 and 2, when all 4 varactors are fixed at 10 pF.

FIG. 20 shows a simulated graph of return loss against frequency for the multi-output chassis-antenna 16 shown in FIGS. 1 and 2, which incorporates a pair of radiating elements 12, 14—this time occupying a volumetric space of 20×2×3.5 mm and having a ground plane of size of 50×20 mm. In accordance with FIG. 3, four varactors ($C_1$, $C_2$, $C_3$ and $C_4$) having a tuning range of 0.1 pF to 10 pF were employed. FIG. 20 illustrates the 4 independent outputs associated with each of the four ports, when all four varactors are fixed at 10 pF. The four resonance frequencies are 670 MHz, 1840 MHz, 3600 MHz and 5190 MHz, respectively, with reflection coefficients of −9.608 dB, −12.81 dB, −13.21 dB and −15.04 dB, respectively. The maximum isolation between the ports is −7.253 dB.

Figure 21:
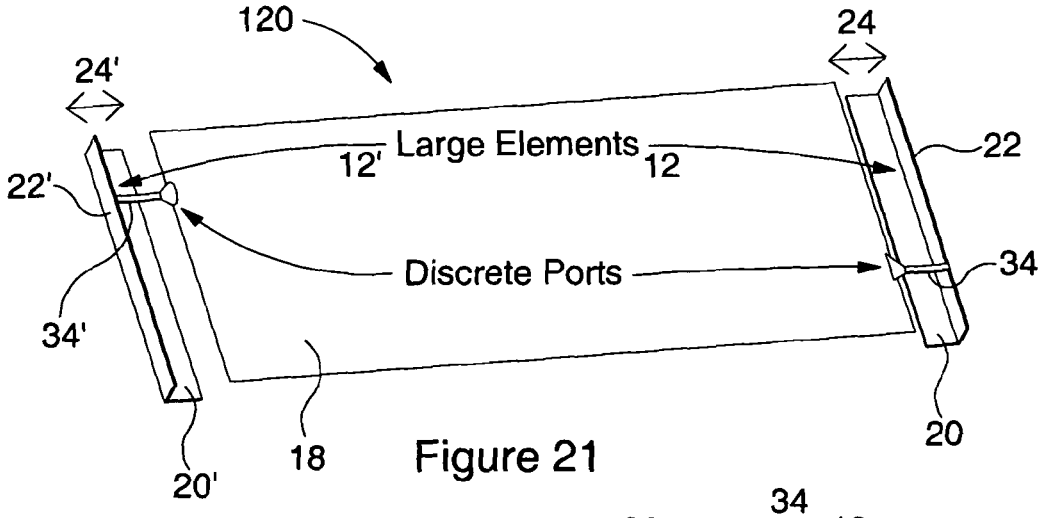
FIG. 21 shows a top perspective view of an embodiment of the present invention which is similar to that shown in FIG. 16 but wherein a second large, radiating element is provided at the opposite end of the substrate to the single, large, radiating element.

FIG. 21 shows a top perspective view of a multi-output antenna 120 which is similar to that shown in FIG. 16 but wherein a second large, radiating element 12' is provided at the opposite end of the handset chassis to the single, large, radiating element 12. The radiating element 12' is constituted by an L-shaped microstrip patch having a planar portion 20', parallel to the ground plane 18, and an orthogonal portion 22', orthogonal to the ground plane 18. The planar portion 20' is provided on the opposite side of a substrate (not shown) from the ground plane 18, laterally spaced therefrom. The orthogonal portion 22' extends from an edge of the planar portion 20' furthest from the ground plane 18 such that the orthogonal portion 22' is spaced from the ground plane 18 by a first gap 24'. In this particular embodiment the first gap 24' is less that 10 mm.

Figure 22:
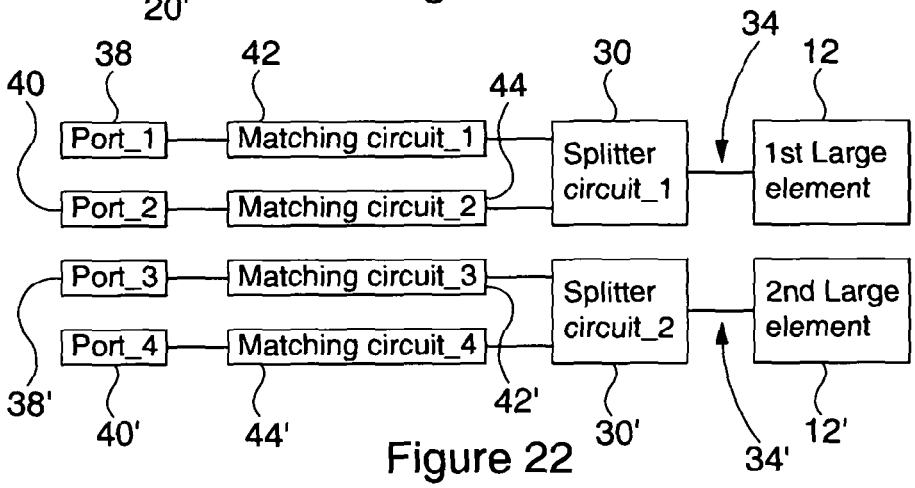
FIG. 22 shows a block diagram of the circuitry associated with each radiating element of FIG. 21.

As shown in FIG. 22, the radiating element 12 is connected to a first splitter circuit 30 via a first feed port 34 as before and the radiating element 12' is connected to a second splitter circuit 30' via a second feed port 34'. Referring back to FIG. 21, the second feed port 34' extends between the orthogonal portion 22' of the radiating element 12' and the second splitter circuit 30' (illustrated in FIG. 17), which is situated close to the farthest edge of the ground plane 18, and is located approximately one third of the distance along the length of the radiating element 12'. Thus, the radiating element 12' is fed towards the opposite edge of the ground plane 18 than the radiating element 12.

As illustrated in FIG. 22, the first splitter circuit 30 is arranged to divide the one and only first feed port 34 of the radiating element 12 into a first port 38 and a second port 40 having, respectively, a first matching circuit 42 and a second matching circuit 44, as previously. The second splitter circuit 30' is similarly arranged to divide the one and only second feed port 34' of the radiating element 12' into a third port 38' and a fourth port 40' having, respectively, a third matching circuit 42' and a fourth matching circuit 44'.

Although not shown separately, the circuit structure corresponding to the arrangement of FIG. 22 is essentially as illustrated in FIG. 3 wherein the small element is replaced by the radiating element 12' which is uncoupled from the radiating element 12. Thus, four varactors ($C_1$, $C_2$, $C_3$ and $C_4$) having a tuning range of 0.1 pF to 10 pF are employed.

Figure 23:
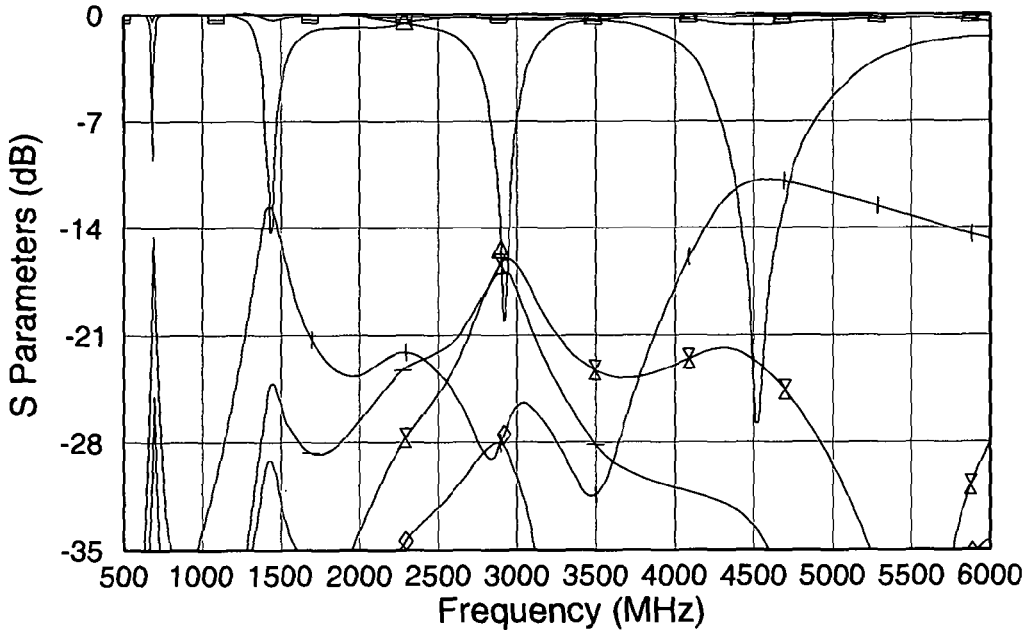
FIG. 23 shows a simulated graph of return loss against frequency for the multi-output chassis-antenna shown in FIGS. 21 and 22, when all 4 varactors are fixed at 10 pF.

FIG. 23 shows a simulated graph of return loss against frequency for the multi-output chassis-antenna 120 shown in FIGS. 21 and 22, when all four varactors are fixed at 10 pF. This results in four separate resonance frequencies at 680 MHz, 1430 MHz, 2910 MHz and 4520 MHz, respectively, with reflection coefficients of −9.498 dB, −14.40 dB, −20.19 dB and −26.9 dB, respectively. The maximum isolation shown in FIG. 23 is −10.84 dB. Thus, with two radiating elements 12, 12' it is possible to have four independent outputs.

Figure 24:
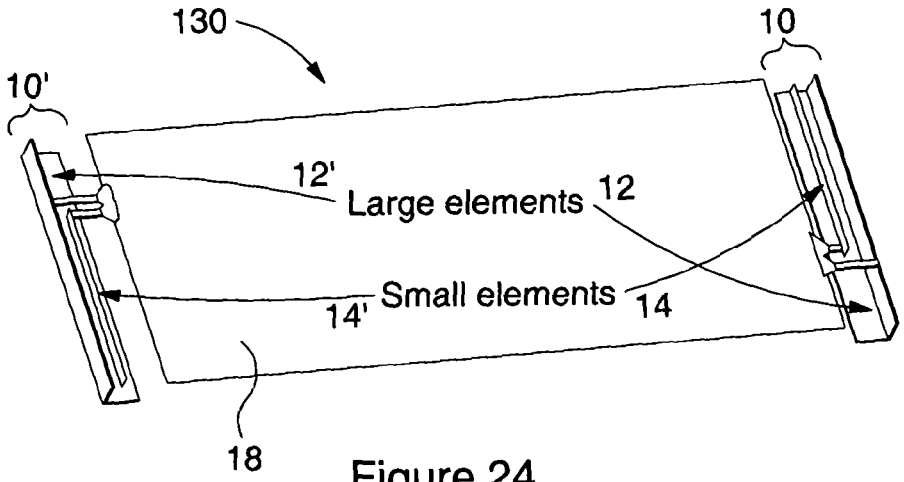
FIG. 24 shows a top perspective view of an embodiment of the present invention which is similar to that shown in FIG. 1 but wherein a second pair of coupled radiating elements is provided at the opposite end of the substrate to the first pair of coupled radiating elements.

FIG. 24 shows a top perspective view of a multi-output antenna 130 which is similar to that shown in FIG. 1 but wherein a second pair 10' of coupled radiating elements 12', 14' is provided at the opposite end of the ground plane 18 to the first pair 10 of coupled radiating elements 12, 14. The structure of each pair of coupled radiating elements is identical to that described previously although in this case, the ground plane has a size of 50×20 mm and each pair of coupled radiating elements occupies a volumetric space of 20×2×3.5 mm. Furthermore, the matching circuit arrangement is as illustrated in FIG. 14, where eight separate ports are employed to produce eight independent outputs using the four radiating elements 12, 14, 12', 14'.

Figure 25:
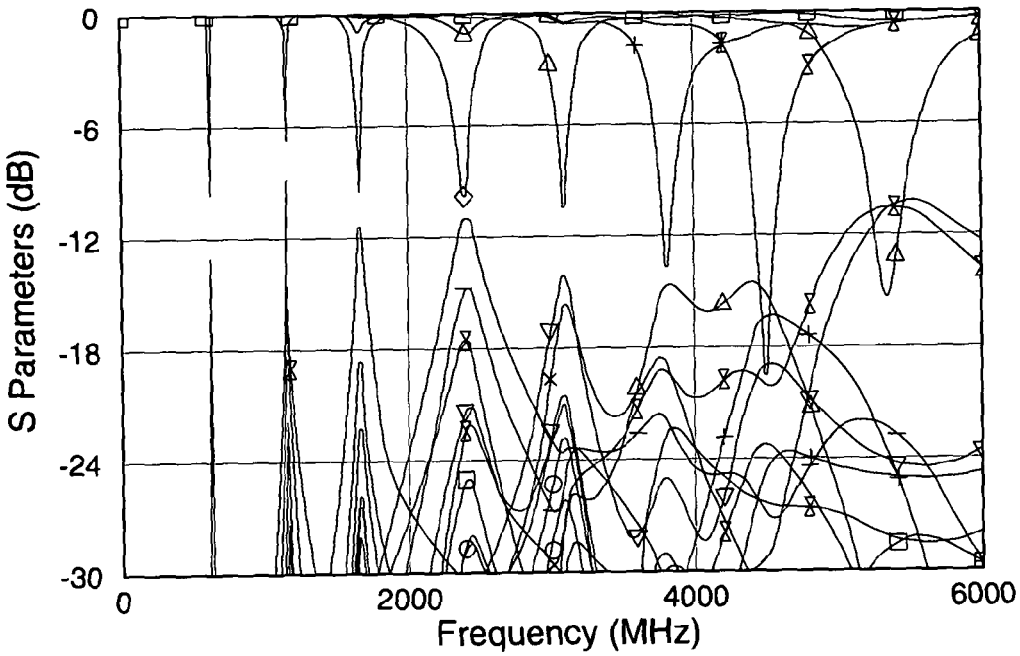
FIG. 25 shows a simulated graph of return loss against frequency for the multi-output chassis-antenna shown in FIG. 24, when all 8 varactors are fixed at 10 pF.

FIG. 25 shows a simulated graph of return loss against frequency for the multi-output chassis-antenna 130 shown in FIG. 24, when all eight varactors (one in each matching circuit) are fixed at 10 pF. The eight different resonance frequencies are 630 MHz, 1170 MHz, 1670 MHz, 2390 MHz, 3090 MHz, 3810 MHz, 4490 MHz and 5340 MHz, respectively, with return losses of −9.612 dB, −6.788 dB, −9.483 dB, −9.857 dB, −10.52 dB, −13.81 dB, −19.53 dB and −15.37 dB, respectively. The maximum isolation shown in FIG. 24 is −8.869 dB.

It will be understood that by varying the value of each varactor in each matching circuit, each output can be tuned over a range of frequencies to cover a large operational envelope. It is also apparent that a single radiating element can be employed with appropriate splitter and matching circuits to provide two outputs with independent frequency tunable behaviour. Similarly, two radiating elements can be employed to provide four outputs and four radiating elements can be employed to provide eight outputs. Other embodiments are also envisaged to produce a desired number of outputs by incorporating a suitable combination of splitter circuits, matching circuits and radiating elements in accordance with the present invention.

Figure 26:
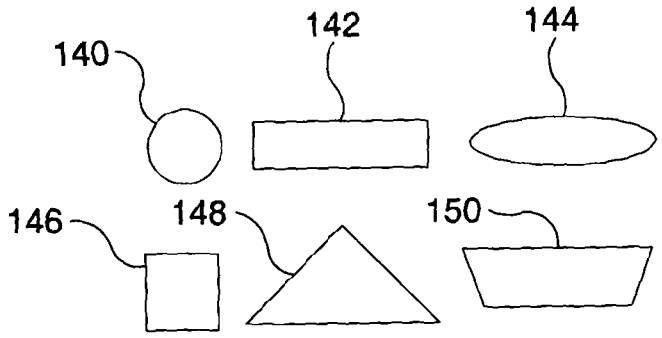
FIG. 26 shows a range of different shapes which may constitute the radiating elements in embodiments of the invention.

FIG. 26 shows a range of different shapes which may constitute the radiating elements used to excite the resonance mode of a substrate (e.g. handset chassis or PCB) in any embodiments of the invention. The shape of the radiating element is not limited to the bracket-shapes described above but can be any shape with any size, i.e. circular 140, rectangular 142, elliptical 144, square 146, triangular 148 or trapezium-shaped 150. It is also noted that the radiating elements may be resonant or, perhaps more often, non-resonant elements.

An aspect of the invention provides for an antenna interface module (AIM) comprising a multi-output antenna as described above and an automatic tuning system (e.g. a universal adaptive tuning system) configured to tune each of the multiple outputs to a target operating frequency. It is proposed that the automatic tuning system may therefore optimise the antenna performance in light of environmental changes and may reduce the effect of a user's hand or body on the operating frequencies. More specifically, the same (universal) antenna interface module may be provided in a number of different devices (e.g. mobile phones) and the automatic tuning system may be employed to compensate for differences in the size and/or shape of each device and, in particular, differences in the size and/or shape of each substrate (e.g. chassis) on which the interface module is mounted.

As described above, the multi-output antenna could be provided with one radiating element configured to provide two outputs, two radiating elements configured to provide four outputs and so on. The resonance frequency of each output would be automatically tuned to the target operating frequency by the automatic tuning system. The AIM could find application in Software Defined systems and Cognitive Radio systems for multi-searching functionality or in any current or future portable devices to optimise the antenna performance during use.

Figure 27:
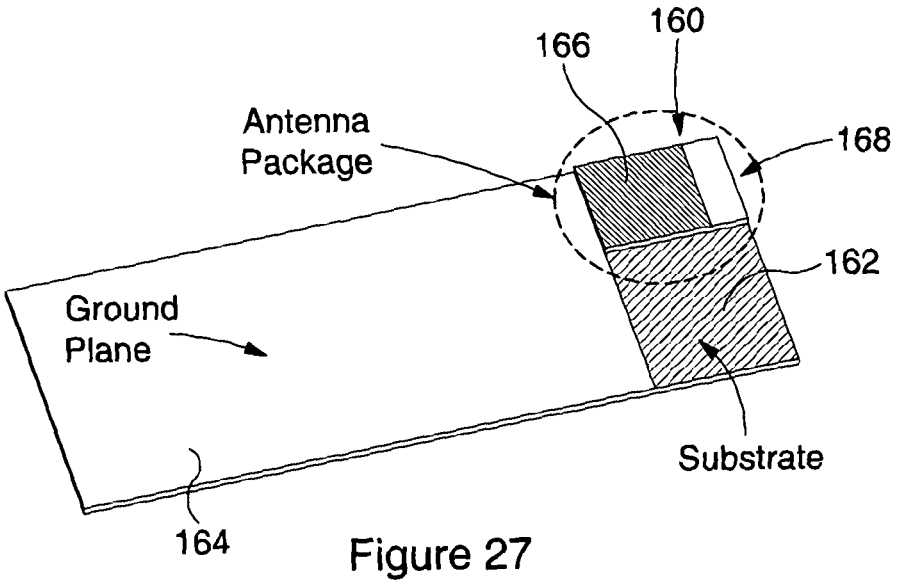
FIG. 27 shows a top perspective view of an embodiment of the present invention which incorporates an antenna interface module on a first antenna chassis.

As illustrated previously, the radiating elements may be provided as external components attached to a chassis antenna substrate. Alternatively, the radiating elements may be configured as part of an antenna interface module 160 which is attached to a chassis antenna substrate 162 as illustrated in FIG. 27. In this embodiment, the antenna interface module 160 is mounted on a corner of the rectangular substrate 162 and a rectangular ground plane 164 is provided on the top surface of the substrate 162 terminating in line with the start of the antenna interface module 160.

Figure 28:
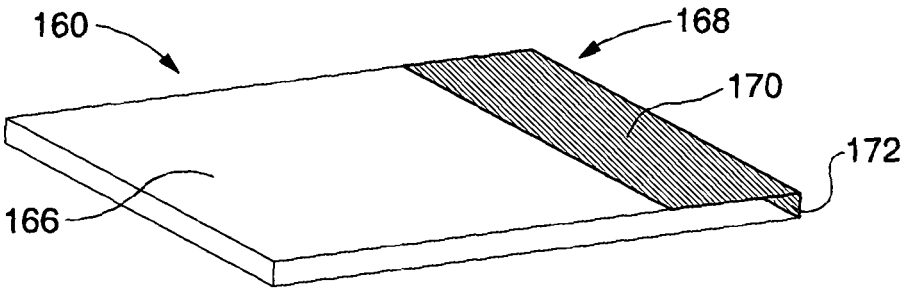
FIG. 28 shows an enlarged top perspective view of the antenna interface module of FIG. 27.

FIG. 28 shows an enlarged top perspective view of the antenna interface module 160. The antenna interface module 160 is constructed from several layers of printed circuit board (PCB) 166 having a single bracket-shaped non-resonant radiating element 168 comprising a planar rectangular portion 170 printed along one edge of the top layer of PCB 166 and a rectangular orthogonal portion 172 depending from the free long edge of the planar portion 170 and extending downwardly for the depth of the PCB 166. Although not shown, the PCB 166 contains all of the circuit components and microprocessors required for the matching circuits, splitter circuit and automatic tuning system associated with the antenna interface module 160. Such an integrated circuit system could be designed and fabricated by any suitable circuit technologies (i.e. simple single or multi-layered PCB (Printed Circuit Board), LTCC (low temperature co-fired ceramic), HTCC (high temperature co-fired ceramic) etc).

Figure 29:
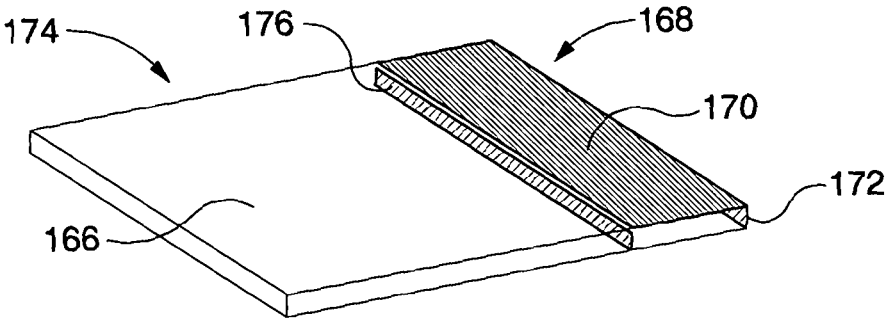
FIG. 29 shows an enlarged top perspective view of an alternative antenna interface module to that shown in FIG. 28.

FIG. 29 shows an enlarged top perspective view of an alternative antenna interface module 174. The antenna interface module 174 is essentially identical to that described above in relation to FIG. 28 but further comprises a second non-resonant radiating element 176 to provide two more outputs. As illustrated, the second radiating element 176 is of similar size and shape to the orthogonal portion 172 but is incorporated within the layers of the PCB 166 such that it essentially extends downwardly through the PCB 166 from adjacent the other long edge of the planar portion 170.

Figure 30A:
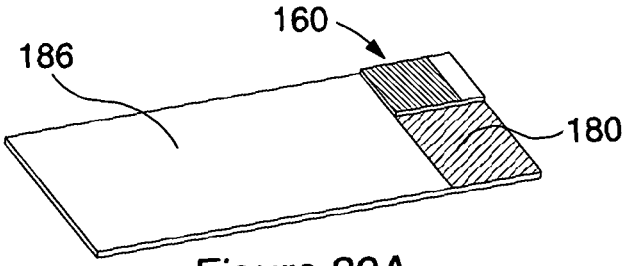
FIG. 30A shows a top perspective view of an embodiment of the present invention which incorporates the antenna interface module of FIG. 28 on a first antenna chassis, which is similar to that shown in FIG. 27.
Figure 30B:
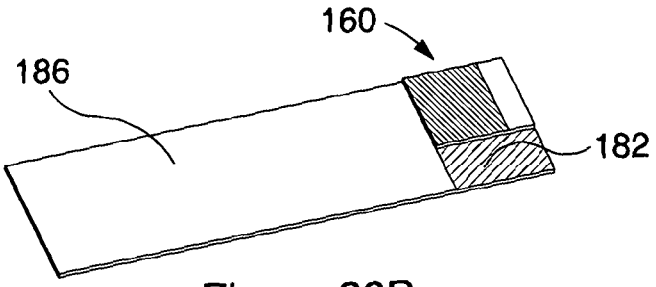
FIG. 30B shows a top perspective view of an embodiment of the present invention which incorporates the antenna interface module of FIG. 28 on a second antenna chassis, which is different in shape to that shown in FIG. 30A.
Figure 30C:
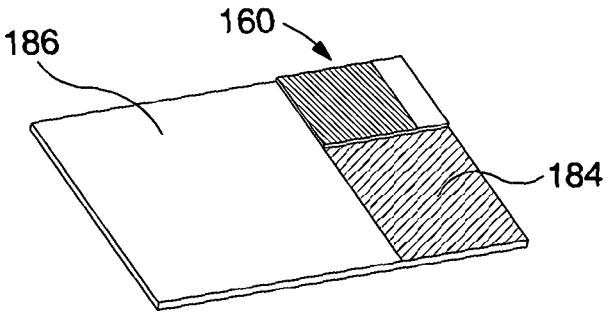
FIG. 30C shows a top perspective view of an embodiment of the present invention which incorporates the antenna interface module of FIG. 28 on a third antenna chassis, which is different in shape to that shown in FIGS. 30A and 30B.

FIGS. 30A through 30C show the antenna interface module 160 of FIG. 28 mounted on various different antenna substrates. The first substrate 180 (of FIG. 30A) is essentially similar to that shown in FIG. 27. The second substrate 182 (of FIG. 30B) is narrower and longer than that shown in FIG. 30A. The third substrate 184 (of FIG. 30C) is wider and shorter than that shown in FIG. 30A. In each case, the antenna interface module 160 is mounted on a corner of the rectangular substrate 180, 182, 184 and a rectangular ground plane 186 is provided on the top surface of the substrate terminating in line with the start of the antenna interface module 160. It will be understood that, in use, each of the antenna interface modules 160 will employ its automatic tuning system to compensate for the different shapes of the substrates 180, 182, 184 so as tune the outputs to the desired operating frequencies. Thus, the antenna interface module 160 is suitable for use in devices (i.e mobile handsets) having different size or shapes, therefore constituting a universal antenna interface module.

Figure 31:
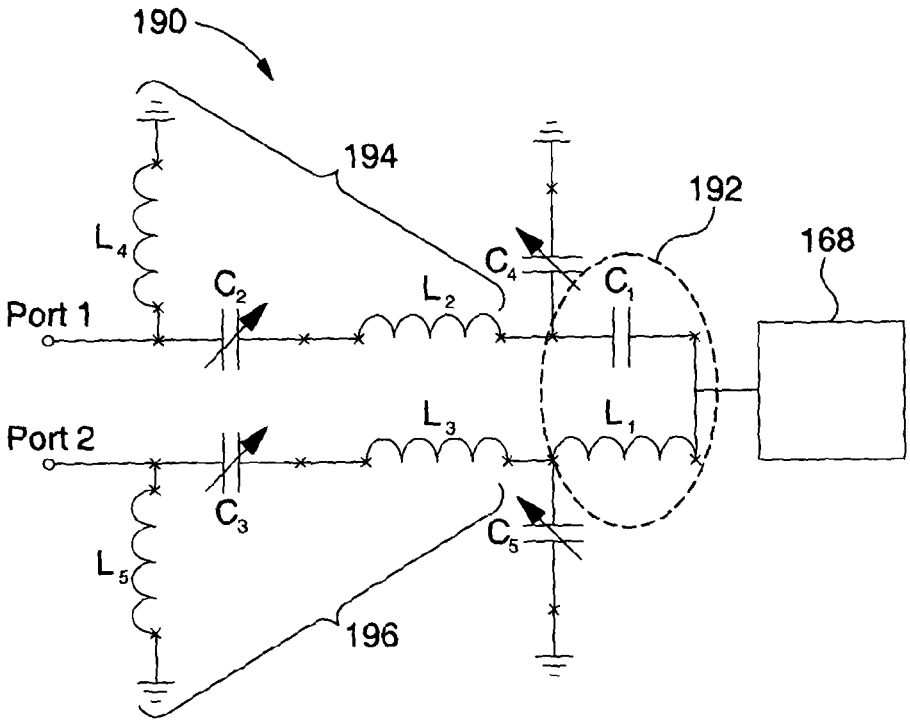
FIG. 31 shows a circuit diagram corresponding to the antenna structure of FIG. 17, with 2 additional varactors provided for an associated automatic tuning system.

FIG. 31 shows a circuit diagram 190 corresponding to the antenna structure of FIG. 17, with 2 additional (shunt) varactors $C_4$ and $C_5$ provided for an associated automatic tuning system. Thus, the circuit diagram 190 is suitable for use in the antenna interface module 160 and comprises a splitter circuit 192 connected to the single radiating element 168, a first matching circuit 194 connected to Port 1 and a second matching circuit 196 connected to Port 2. The additional varactors $C_4$ and $C_5$ are provided between the splitter circuit 192 and each matching circuit 194, 196 and connected to ground. In practice, the value of each of the additional varactors $C_4$ and $C_5$ will be controlled by the automatic tuning system as will be described below so as to retune each Port to a desired output frequency. It will be noted that the varactors $C_2$ and $C_3$ in each matching circuit 194, 196 are still employed to achieve the wide tuning range of each associated output.

Figure 32:
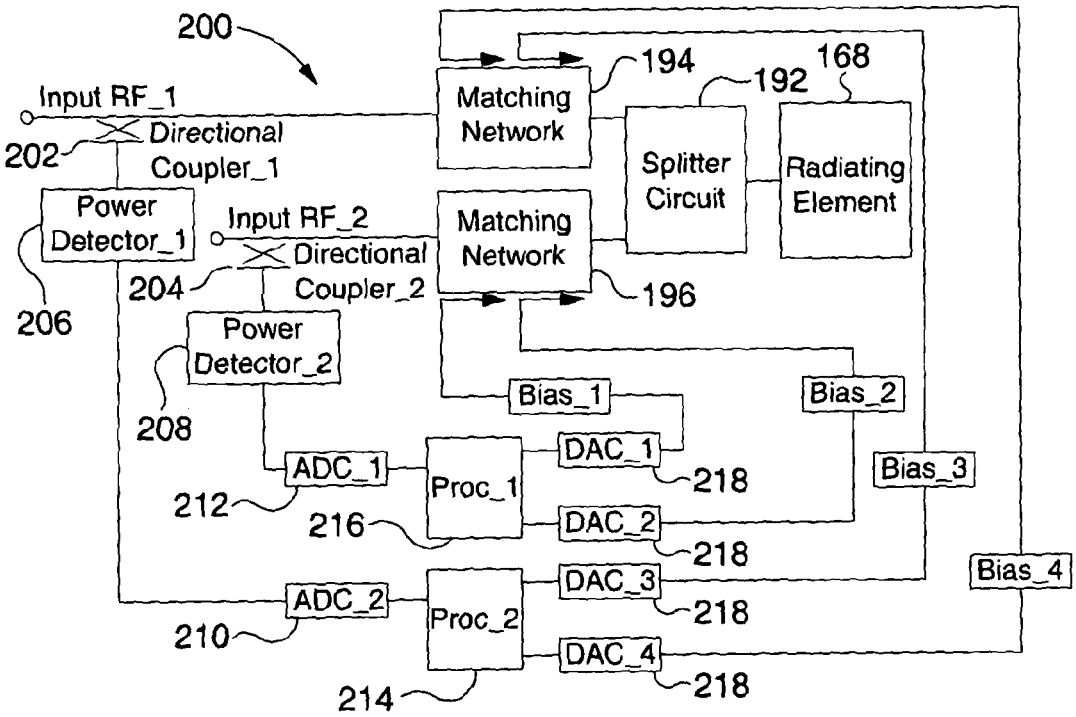
FIG. 32 shows a block diagram of an automatic tuning system for use with the circuit diagram of FIG. 31.

FIG. 32 shows a block diagram of an automatic tuning system 200 for use with the circuit diagram 190 of FIG. 31 in the antenna interface module 160. The automatic tuning system 200 is arranged to monitor a power level of a reflected signal of the target operating frequency at each port (Input RF_1 and Input RF_2) and to adjust a bias voltage of the respective additional varactors $C_4$ and $C_5$ so as to minimise the power level of the reflected signal. As illustrated, the automatic tuning system 200 therefore further comprises a directional coupler 202, 204 connected, respectively, to each port, a power detector 206, 208 connected, respectively, to each directional coupler 202, 204, a sampling analogue to digital converter (ADC) 210, 212 connected, respectively, to each power detector 206, 208, a microprocessor 214, 216 connected, respectively, to each ADC 210, 212 and 2 digital to analogue converters (DAC) 218 connected, respectively, to each of the microprocessors 214, 216. Each microprocessor 214, 216 employs an appropriate algorithm which is configured to provide a bias voltage (via the DACs 218) to an associated one of the varactors $C_2$, $C_3$, $C_4$, $C_5$ in the circuit diagram 190.

Figure 33:
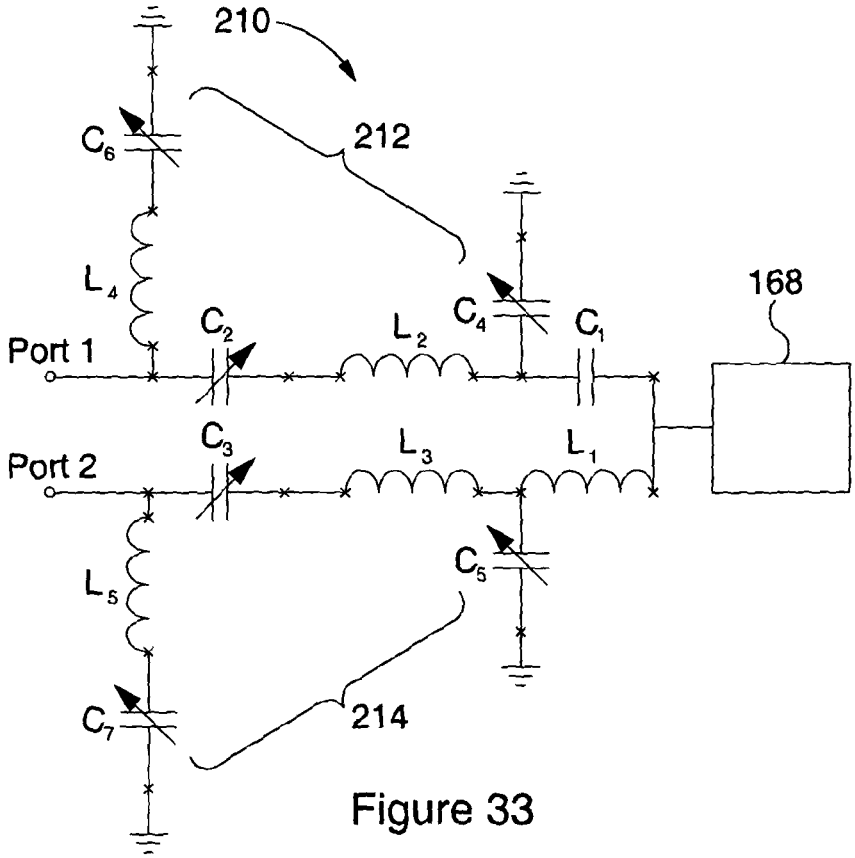
FIG. 33 shows a circuit diagram corresponding to the antenna structure of FIG. 17, with 4 additional varactors provided for an associated automatic tuning system.

FIG. 33 shows a circuit diagram 210 corresponding to the antenna structure of FIG. 31, with a further 2 additional (shunt) varactors $C_6$ and $C_7$ provided for an associated automatic tuning system to improve the matching performance of the AIM, offer more flexibility and improve the signal sensitivity in different environments. The circuit diagram 210 is essentially as described in relation to FIG. 31 but with the 2 additional (shunt) varactors $C_6$ and $C_7$ connected respectively to an initial shunt inductor $L_4$ and $L_5$ in each matching circuit 212, 214 and then connected to the ground. Thus, the single radiating element 168 is provided with two matching circuits 212, 214, each of which comprises three varactors.

Figure 34:
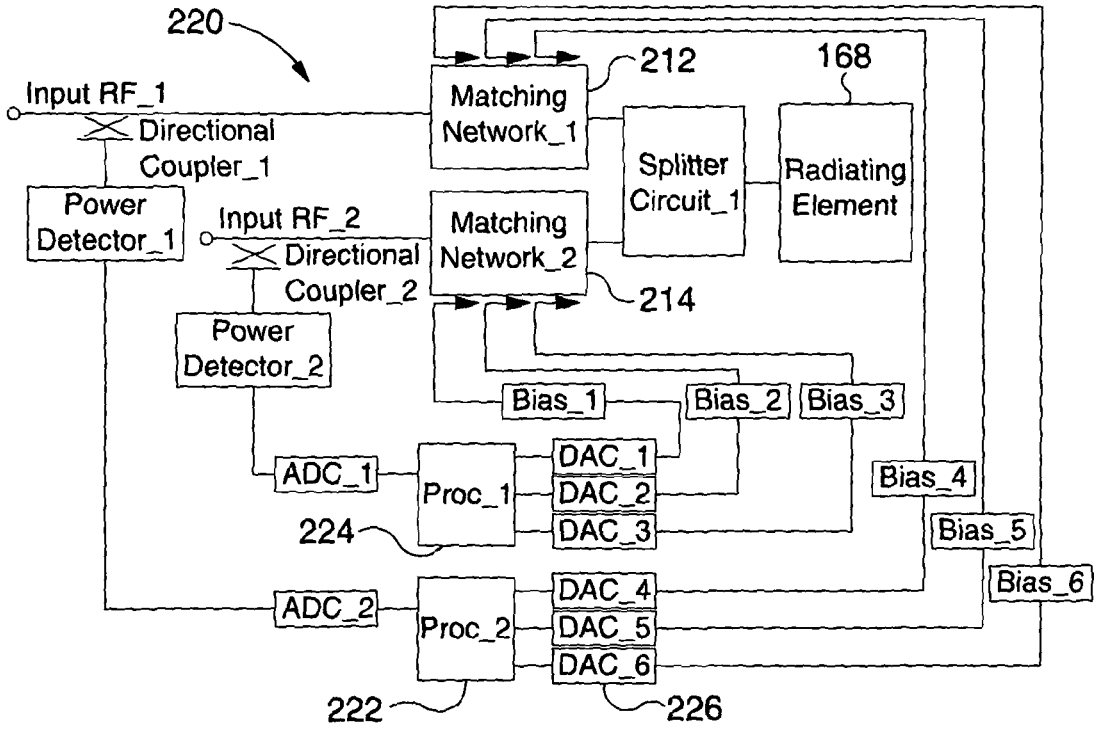
FIG. 34 shows a block diagram of an automatic tuning system for use with the circuit diagram of FIG. 33.

FIG. 34 shows a block diagram of an automatic tuning system 220 for use with the circuit diagram 210 of FIG. 33 in the antenna interface module 160. The automatic tuning system 220 is substantially as described above in relation to FIG. 32 but with each microprocessor 222, 224 employing an appropriate algorithm which is configured to provide a bias voltage (via 3 separate DACs 226) to an associated one of the three varactors in each matching circuit 212, 214. Thus, the automatic tuning system 220 comprises 6 DACs 226 in total, connected to the 6 varactors in the circuit diagram of FIG. 33.

According to the above, embodiments of the present invention provide a multi-output tunable antenna which is able to cover existing cellular services such as DVB-H, GSM710, GSM850, GSM900, GPS1575, GSM1800, PCS1900, UMTS2100 and WiFi bands simultaneously. The antenna is also suitable for Cognitive Radio systems which might require a multi-resolution spectrum sensing function. The proposed antenna is therefore an ideal candidate for portable devices which require multi-service access simultaneously, and is particular well suited to applications involving small terminals such as smart phones, laptops and PDAs.

It will be appreciated by persons skilled in the art that various modifications may be made to the above-described embodiments without departing from the scope of the present invention. In particular, features described in relation to one embodiment may be incorporated into other embodiments also.

The invention claimed is:

1. A multi-output antenna comprising:

a non-resonant radiating element mounted on a chassis including a ground plane, the chassis being configured as a radiating chassis and the non-resonant radiating element being configured to excite multiple resonance modes of the radiating chassis so as to provide multiple outputs;

a splitter circuit; and at least first and second matching circuits coupled to the non-resonant radiating element by way of the splitter circuit, the splitter circuit configured to direct higher frequency signals to the first matching circuit and lower frequency signals to the second matching circuit;

wherein each matching circuit is associated with a separate port arranged to drive a separate resonant frequency so that the radiating element is operable to provide multiple outputs simultaneously;

wherein the at least first and second matching circuits are configured so that the radiating element is operable simultaneously to receive in a first frequency band containing the higher frequency signals via the first matching circuit and in a second frequency band containing the lower frequency signals via the second matching circuit;

wherein the at least first and second matching circuits are each independently adjustable by way of at least one variable capacitor provided in each of the first and second matching circuits; and wherein the splitter circuit comprises an inductor and a capacitor each having respective first and second electrical connections, the inductor and capacitor being arranged with the first electrical connections joined at a T-junction, the T-junction connected to the non-resonant radiating element, the second electrical connection of the capacitor connected to the first matching circuit and the second electrical connection of the inductor connected to the second matching circuit, such that the ports are substantially uncorrelated, thereby allowing the first matching circuit to be adjusted so as to tune the signal in the first frequency band without affecting the tuning of the signal in the second frequency band and the second matching circuit to be adjusted so as to tune the signal in the second frequency band without affecting the tuning of the signal in the first frequency band.

2. The multi-output antenna according to claim 1, wherein the splitter circuit serves to divide a single feed port provided for the radiating element into two or more ports.

3. The multi-output antenna according to claim 1, wherein more than two matching circuits and ports are associated with the non-resonant radiating element.

4. The multi-output antenna according to claim 1, a pair of non-resonating radiating elements, each of which is coupled to two matching circuits which are in turn associated with two different ports so that the multi-output antenna is operable to provide up to four outputs simultaneously.

5. The multi-output antenna according to claim 4, wherein the pair of radiating elements are mutually coupled and each has an associated feed port which is split into two separate ports, and wherein each port is provided with a separate impedance-matching circuit configured for independent tuning of one of two distinct outputs associated with each radiating element.

6. The multi-output antenna according to claim 4, wherein a first feed port is provided between a first non-resonant radiating element and a first splitter circuit, and wherein a second feed port is provided between a second non-resonant radiating element and a second splitter circuit.

7. The multi-output antenna according to claim 6, wherein the first feed port is located off-centre with respect to the first radiating element.

8. The multi-output antenna according to claim 6, wherein the second feed port is placed in close proximity to the first feed port.

9. The multi-output antenna according to claim 1, wherein the chassis comprises a substrate having the ground plane formed on a first side thereof.

10. The multi-output antenna according to claim 9, wherein a first radiating element is provided on a second side of the substrate, opposite to the first side, and laterally spaced from the ground plane.

11. The multi-output antenna according to claim 10, wherein the first radiating element is constituted by an L-shaped metal patch, having a planar portion and a portion orthogonal to the ground plane.

12. The multi-output antenna according to claim 11, wherein the orthogonal portion extends from an edge of the planar portion furthest from the ground plane such that the orthogonal portion is spaced from the ground plane by a first gap.

13. The multi-output antenna according to claim 12, wherein a second radiating element is constituted by a planar metal patch, orthogonal to the ground plane.

14. The multi-output antenna according to claim 13, wherein the second radiating element is located between the ground plane and the orthogonal portion of the first radiating element.

15. The multi-output antenna according to claim 1, wherein each port is connected to a control system configured to select an operating state of the associated output.

16. An antenna structure comprising:

one or more multi-output antennas; and one or more further antennas;

wherein each of the one or more multi-output antennas comprises:

a non-resonant radiating element mounted on a chassis including a ground plane, the chassis being configured as a radiating chassis and the non-resonant radiating element being configured to excite multiple resonance modes of the radiating chassis so as to provide multiple outputs;

a splitter circuit; and at least first and second matching circuits coupled to the non-resonant radiating element by way of the splitter circuit, the splitter circuit configured to direct higher frequency signals to the first matching circuit and lower frequency signals to the second matching circuit;

wherein each matching circuit is associated with a separate port arranged to drive a separate resonant frequency so that the radiating element is operable to provide multiple outputs simultaneously;

wherein the at least first and second matching circuits are configured so that the radiating element is operable simultaneously to receive in a first frequency band containing the higher frequency signals via the first matching circuit and in a second frequency band containing the lower frequency signals via the second matching circuit;

wherein the at least first and second matching circuits are each independently adjustable by way of at least one variable capacitor provided in each of the first and second matching circuits; and wherein the splitter circuit comprises an inductor and a capacitor each having respective first and second electrical connections, the inductor and capacitor being arranged with the first electrical connections joined at a T-junction, the T-junction connected to the non-resonant radiating element, the second electrical connection of the capacitor connected to the first matching circuit and the second electrical connection of the inductor connected to the second matching circuit, such that the ports are substantially uncorrelated, thereby allowing the first matching circuit to be adjusted so as to tune the signal in the first frequency band without affecting the tuning of the signal in the second frequency band and the second matching circuit to be adjusted so as to tune the signal in the second frequency band without affecting the tuning of the signal in the first frequency band.

17. The antenna structure according to claim 16, wherein the one or more further antennas are constituted by a balanced or an unbalanced antenna that is reconfigurable.

18. The antenna structure according to claim 16, wherein the one or more multi-output antennas comprise a plurality of multi-output antennas, and wherein the one or more further antennas each comprise one of the plurality of multi-output antennas.

19. The antenna structure according to claim 18, wherein a first antenna of the plurality of multi-output antennas is located at a first end of the structure, and wherein a second antenna of the plurality of multi-output antennas is located at a second end of the structure.

20. An antenna interface module for coupling a non-resonant radiating element mounted on a chassis including a groundplane, the chassis being configured as a radiating chassis and the non-resonant radiating element being configured to excite multiple resonance modes of the radiating chassis so as to provide multiple outputs, the antenna interface module comprising:

a splitter circuit; and at least first and second matching circuits arranged for coupling to the non-resonant radiating element by way of the splitter circuit, the splitter circuit configured to direct higher frequency signals to the first matching circuit and lower frequency signals to the second matching circuit;

wherein each matching circuit is associated with a separate port arranged to drive a separate resonant frequency so that the radiating element is operable to provide multiple outputs simultaneously;

wherein the at least first and second matching circuits are configured so that the radiating element, when coupled to the control module, is operable simultaneously to receive in a first frequency band containing the higher frequency signals via the first matching circuit and in a second frequency band containing the lower frequency signals via the second matching circuit;

wherein the at least first and second matching circuits are each independently adjustable by way of at least one variable capacitor in each of the first and second matching circuits; and wherein the splitter circuit comprises an inductor and a capacitor each having respective first and second electrical connections, the inductor and capacitor being arranged with the first electrical connections joined at a T-junction, the T-junction for connection to the non-resonant radiating element, the second electrical connection of the capacitor connected to the first matching circuit and the second electrical connection of the inductor connected to the second matching circuit, such that the ports are substantially uncorrelated, thereby allowing the first matching circuit to be adjusted so as to tune the signal in the first frequency band without affecting the tuning of the signal in the second frequency band and the second matching circuit to be adjusted so as to tune the signal in the second frequency band without affecting the tuning of the signal in the first frequency band.

* * * * *